US011399574B2

(12) United States Patent
Mumford

(10) Patent No.: US 11,399,574 B2
(45) **Date of Patent: *Aug. 2, 2022**

(54) AEROSOL-GENERATING APPARATUS, THERMAL DISTRIBUTION CASING, AND RELATED METHODS

(71) Applicant: John Robert Mumford, Oakville (CA)

(72) Inventor: John Robert Mumford, Oakville (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/584,453

(22) Filed: Jan. 26, 2022

(65) Prior Publication Data

US 2022/0142264 A1 May 12, 2022

Related U.S. Application Data

(63) Continuation of application No. 17/115,835, filed on Dec. 9, 2020.

(Continued)

(51) Int. Cl.
*A24F 42/60* (2020.01)
*A24F 40/60* (2020.01)

(Continued)

(52) U.S. Cl.
CPC ..... *A24F 42/60* (2020.01); *A24F 9/16* (2013.01); *A24F 13/28* (2013.01); *A24F 40/60* (2020.01); *A24F 42/20* (2020.01)

(58) Field of Classification Search
CPC ..... A24F 13/28; A24F 13/02–14
See application file for complete search history.

(56) References Cited

U.S. PATENT DOCUMENTS 8,430,106 B2 4/2013 Potter et al.
9,272,103 B2 3/2016 Storz (Continued)

FOREIGN PATENT DOCUMENTS

CA 3127614 A1 8/2020
EP 2938377 B1 2/2019

(Continued)

OTHER PUBLICATIONS

Vranks, Luxury Customization Company Launches 24-ct-Gold-Plated E-cigarette, 2014, Vape Ranks (Year: 2014).*

(Continued)

*Primary Examiner* — Anthony Calandra
(74) *Attorney, Agent, or Firm* — Bereskin & Parr LLP/S.E.N.C.R.L., s.r.l.

(57) ABSTRACT

An aerosol-generating apparatus includes a mouthpiece, an aerosolizing thermal reactor, and an air preheating passage. The aerosolizing thermal reactor has an air inlet upstream of an aerosol outlet, and includes an aerosolizable substance chamber and a thermal distribution casing. The thermal distribution casing surrounds the aerosolizable substance chamber and includes a laminate material with an at least three-layer construction including a metal middle layer between a metal outer layer and a metal inner layer. The thermal conductivity of the metal inner layer is at least double that of each of the metal outer and inner layers. The air preheating passage is located downstream of the air inlet and upstream of the aerosolizable substance chamber, and surrounds the aerosolizable substance chamber. The air preheating passage is defined by an air gap between the chamber outer wall and the metal inner layer.

13 Claims, 9 Drawing Sheets

Related U.S. Application Data

(60) Provisional application No. 62/950,399, filed on Dec. 19, 2019.

(51) Int. Cl.

| | |
|---|---|
| ***A24F 13/28*** | (2006.01) |
| ***A24F 9/16*** | (2006.01) |
| ***A24F 42/20*** | (2020.01) |

(56) References Cited

U.S. PATENT DOCUMENTS

| | | | | |
|---|---|---|---|---|
| 10,194,691 | B2 * | 2/2019 | Sebastian | G09F 3/0291 |
| 10,206,425 | B2 | 2/2019 | Breiwa, III | |
| 11,191,921 | B1 | 12/2021 | Hudgins et al. | |
| 11,213,073 | B2 | 1/2022 | Breiwa, III et al. | |
| 2014/0186015 | A1 * | 7/2014 | Breiwa, III | A24F 40/60 392/386 |
| 2017/0013877 | A1 | 1/2017 | Breiwa, III | |
| 2019/0216131 | A1 | 7/2019 | Breiwa, III | |
| 2020/0288543 | A1 | 9/2020 | Breiwa, III et al. | |
| 2020/0323267 | A1 | 10/2020 | Breiwa, III | |
| 2021/0007188 | A1 | 1/2021 | Breiwa, III et al. | |
| 2021/0007394 | A1 | 1/2021 | Breiwa, III | |
| 2021/0008242 | A1 | 1/2021 | Breiwa, III | |
| 2021/0014941 | A1 | 1/2021 | Breiwa, III et al. | |
| 2021/0186118 | A1 | 6/2021 | Mumford | |
| 2021/0259324 | A1 | 8/2021 | Breiwa, III | |
| 2021/0289835 | A1 * | 9/2021 | Rouse | A24F 7/02 |
| 2021/0353883 | A1 | 11/2021 | Breiwa, III | |

FOREIGN PATENT DOCUMENTS

| | | | | |
|---|---|---|---|---|
| EP | 3322311 | B1 | 10/2020 | |
| EP | 3788892 | A1 | 3/2021 | |
| TW | i739172 | B * | 9/2021 | A24F 47/00 |

OTHER PUBLICATIONS

The Engineering Toolbox, Metals, Metallic Elements, and Alloys—Thermal conductivities, downloaded online May 2022 (Year: 2022).*

* cited by examiner

AEROSOL-GENERATING APPARATUS, THERMAL DISTRIBUTION CASING, AND RELATED METHODS

FIELD

This application relates to the field of aerosol-generating apparatus, thermal distribution casings, and related methods.

INTRODUCTION

Vaping is the inhalation of an aerosol. The aerosol may be formed by heating an aerosolizable substance contained within an aerosol-generating apparatus thereby aerosolizing the volatile components of the aerosolizable substance into an aerosol (e.g. a gas or vapor, or a colloidal suspension of solid or liquid particles of the base substance in a gas or vapor). Immediately after aerosolizing, the aerosol may cool and mix with surrounding air, whereby the aerosol may condense before inhalation by a user.

DRAWINGS

SUMMARY

Figure 1:
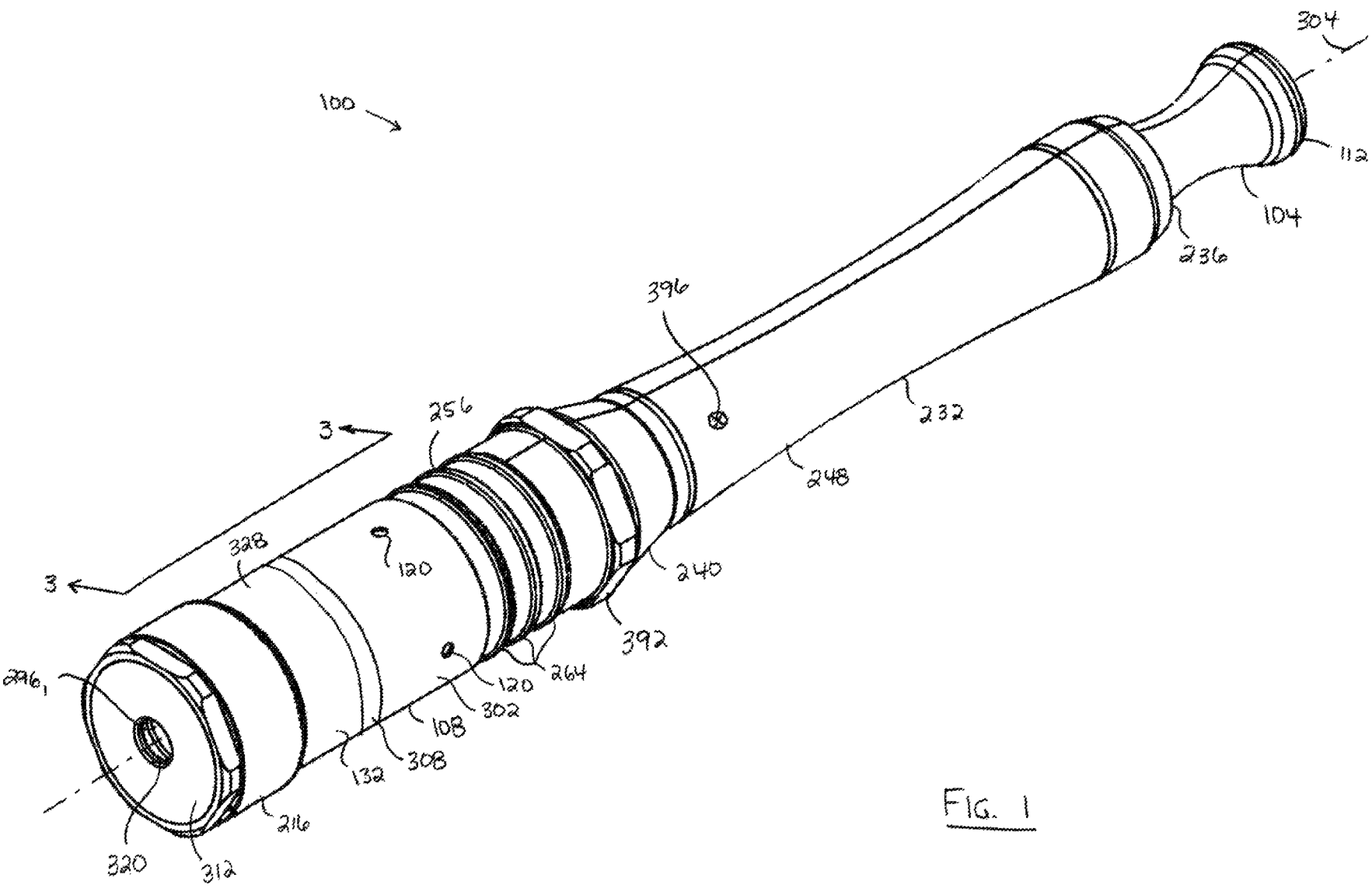
FIG. 1 is a perspective view of an aerosol-generating apparatus, in accordance with an embodiment.

In one aspect, an aerosol-generating apparatus is provided. The aerosol-generating apparatus may include a mouthpiece, an aerosolizing thermal reactor, and an air preheating passage. The mouthpiece may have an inhalation outlet. The aerosolizing thermal reactor may have an air inlet upstream of an aerosol outlet. The aerosol outlet may be upstream of the inhalation outlet. The aerosolizing thermal reactor may include an aerosolizable substance chamber and a thermal distribution casing. The aerosolizable substance chamber may have a chamber outer wall surrounding a chamber inner volume, the chamber inner volume located upstream of the aerosol outlet. The thermal distribution casing may surround the aerosolizable substance chamber. The thermal distribution casing may include a laminate material with an at least three-layer construction including a metal middle layer between a metal outer layer and a metal inner layer. The metal middle layer may be composed of a middle metal material having a middle thermal conductivity.

The metal outer layer may be composed of an outer metal material having an outer thermal conductivity. The metal inner layer may be composed of an inner metal material having an inner thermal conductivity. The middle thermal conductivity may be at least double each of the outer thermal conductivity and the inner thermal conductivity. The air preheating passage may be located downstream of the air inlet and upstream of the aerosolizable substance chamber. The air preheating passage may surround the aerosolizable substance chamber. The air preheating passage may be defined by an air gap between the chamber outer wall and the metal inner layer.

In another aspect, an aerosol-generating apparatus is provided. The aerosol-generating apparatus may include a mouthpiece, an aerosolizing thermal reactor, an air preheating passage, and a sensory casing temperature indicator. The mouthpiece may have an inhalation outlet. The aerosolizing thermal reactor may have an air inlet upstream of an aerosol outlet. The aerosol outlet is upstream of the inhalation outlet. The aerosolizing thermal reactor may include an aerosolizable substance chamber and a thermal distribution casing. The aerosolizable substance chamber may have a chamber outer wall surrounding a chamber inner volume, the chamber inner volume located upstream of the aerosol outlet. The thermal distribution casing may surround the aerosolizable substance chamber. The air preheating passage may be located downstream of the air inlet and upstream of the aerosolizable substance chamber. The air preheating passage may surround the aerosolizable substance chamber, and the air preheating passage may be defined by an air gap between the chamber outer wall and the thermal distribution casing. The sensory casing temperature indicator may be thermally coupled to the thermal distribution casing. The sensory chamber temperature indicator may be thermally coupled to the aerosolizable substance chamber.

In another aspect, a thermal distribution casing for an aerosol-generating apparatus body is provided. The thermal distribution casing includes a sidewall and a transverse distal end portion. The sidewall may extend longitudinally from a sidewall proximal end to a sidewall distal end. The sidewall may include a laminate material with an at least three-layer construction including a metal middle layer between a metal outer layer and a metal inner layer. The metal middle layer may be composed of a middle metal material having a middle thermal conductivity. The metal outer layer may be composed of an outer metal material having an outer thermal conductivity. The metal inner layer may be composed of an inner metal material having an inner thermal conductivity. The middle thermal conductivity may be at least double each of the outer thermal conductivity and the inner thermal conductivity. The transverse distal end portion may cover the sidewall distal end. The distal end portion may include a sensory temperature indicator. The sidewall and distal end portion may together define a body receiving chamber for an aerosol generating apparatus body. The body receiving chamber may extend longitudinally from a body entry port at the sidewall proximal end to a chamber distal end proximate the distal end portion.

In another aspect, an aerosol-generating apparatus is provided. The aerosol-generating apparatus may include a thermal distribution casing, a heat shield, an air preheating passage, and an electric heater. The thermal distribution casing may define an aerosolizable substance receiving chamber. The aerosolizable substance receiving chamber may extending longitudinally from a chamber entry port at a proximal end of the thermal distribution casing. The thermal distribution casing may include a laminate material with an at least three-layer construction including a metal middle layer between a metal outer layer and a metal inner layer. The metal middle layer may be composed of a middle metal material having a middle thermal conductivity. The metal outer layer may be composed of an outer metal material having an outer thermal conductivity. The metal inner layer may be composed of an inner metal material having an inner thermal conductivity. The middle thermal conductivity may be at least double each of the outer thermal conductivity and the inner thermal conductivity. The heat shield may surround the thermal distribution casing. The air preheating passage may be located upstream of the aerosolizable substance chamber. The air preheating passage may surround the thermal distribution casing. The air preheating passage may be defined by an air gap between the heat shield and the metal outer layer. The electric heater may be thermally coupled to the thermal distribution casing.

In another aspect, a method of generating an aerosol from an aerosolizable substance is provided. The method may include:

(i) exposing an aerosolizing thermal reactor to an external heat source until a first sensory temperature indicator generates an alert, the aerosolizing thermal reactor containing an aerosolizable substance;

(ii) immediately after (i), ceasing said exposing the aerosolizing thermal reactor to the external heat source for a first period of time of at least 2 seconds;

(iii) immediately after (ii), exposing the aerosolizing thermal reactor to the external heat source until a second sensory temperature indicator generates an alert; and (iv) after (iii), drawing air through the aerosolizing thermal reactor to withdraw aerosol generated from the aerosolizable substance.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

As used herein and in the claims, a first element is said to be 'communicatively coupled to' or 'communicatively connected to' or 'connected in communication with' a second element where the first element is configured to send or receive electronic signals (e.g. data) to or from the second element, and the second element is configured to receive or send the electronic signals from or to the first element. The communication may be wired (e.g. the first and second elements are connected by one or more data cables), or wireless (e.g. at least one of the first and second elements has a wireless transmitter, and at least the other of the first and second elements has a wireless receiver). The electronic signals may be analog or digital. The communication may be one-way or two-way. In some cases, the communication may conform to one or more standard protocols (e.g. SPI, $I^2C$, Bluetooth™, or IEEE™ 802.11).

As used herein and in the claims, two components are said to be "fluidly connected" or "fluidly coupled" where the two components are positioned along a common fluid flow path. The fluid connection may be formed in any manner that can transfer fluids between the two components, such as by a fluid conduit which may be formed as a pipe, hose, channel, or bored passageway. One or more other components can be positioned between the two fluidly coupled components. Two components described as being "downstream" or "upstream" of one another, are by implication fluidly connected.

As used herein and in the claims, a group of elements are said to 'collectively' perform an act where that act is performed by any one of the elements in the group, or performed cooperatively by two or more (or all) elements in the group.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

As used herein and in the claims, "evaporation" means a change of state from a liquid and/or solid to a gas, vapor, or combination of gas and vapor. Similarly, as used herein and in the claims "evaporation point" means (i) in respect of a liquid, the boiling point of the liquid given the surrounding pressure, and (ii) in respect of a solid, the sublimation temperature of the solid given the surrounding pressure.

As used herein an in the claims, an "evaporated substance" may be a gas and/or vapor form of the substance, a colloidal suspension of solid or liquid particles of the substance in a gas or vapor, or combinations thereof.

As used herein and in the claims, to "aerosolize" means (i) to generate from a base substance an ultra-fine spray, vapor, or colloidal suspension in gas or vapor, and/or (ii) to evaporate at least a portion (e.g. a component) of the base substance. Similarly, as used herein and in the claims, an "aerosol" means a gas and/or vapor derived from a base substance, a colloidal suspension of solid and/or liquid particles of the base substance in a gas or vapor, or combinations thereof.

As used herein and in the claims, "thermal conductivity" of a material means the thermal conductivity of that material (e.g. as expressed in W/(m·K)) at 20° C.

As used herein and in the claims, a "therapeutic substance" is a substance that when taken into the body (e.g. inhaled, injected, smoked, consumed, or absorbed) causes a temporary physiological and/or psychological change in the body. Therapeutic substance excludes basic nutrients and water. In some examples, a therapeutic substance may be a medicine, i.e. a chemical drug that may be used to treat, cure, ameliorate, or prevent a medical condition (e.g. disease) or any symptom thereof. In some examples, a therapeutic substance may be a psychoactive chemical (e.g. depressant, stimulant, or hallucinogen) that when taken affects the central nervous system thereby altering perception, mood, or consciousness.

For clarity of illustration, the description below may refer to the therapeutic substances tetrahydrocannabinol (THC) and cannabidiol (CBD). However, it is expressly contemplated that the methods and apparatus disclosed also apply to other therapeutic substances, including for example other medicines and psychoactive chemicals. For example, the methods and apparatus disclosed below may be adapted for use with aerosolizable substances containing nicotine, caffeine, and alcohol.

One class of aerosol-generating apparatus are e-liquid vaporizers that may use a battery to send electrical current through a wire that is coiled several times to create resistance and heat. An absorbent wick, such as cotton, may bring an aerosol substrate in the form of an e-liquid to the heated wire. The e-liquid is evaporated and inhaled by the user. E-liquids can include various therapeutic substances as ingredients, such as for example nicotine, THC, and CBD. These active ingredients are dissolved or suspended in a variety of carrier liquids including primarily propylene glycol and vegetable glycerine. In addition, other diluents, thinners, thickeners, flavors, and contaminants have been found in e-liquids studied by government agencies. Some e-liquid vaporizers have recently been associated with an elevated rates of lung illness, and a significant number of hospitalizations and even deaths.

A second class of aerosol generating systems utilizes exclusively natural plant-derived materials as the aerosolizable substance. These natural plant materials can be, for example dried flower or herbal mixtures, plant-extracted oils or resins, or combinations thereof. In this second class of vaporizers, the aerosolizable substance is heated by a chemical, electrical, or fuel-combustion heat source to generate an aerosol for subsequent inhalation. Unlike e-liquid vaporizers, the aerosolizable substance does not typically include added flavors, additives, diluents, or carrier agents.

Within this second class of natural plant material vaporizers, the overwhelming number of vaporizers are electronic being either line (e.g. mains powered) or battery powered. Such vaporizers may employ one of a number of different electric heating methods. One heating method includes a small electric oven that heats the contained aerosolizable substance. A second heating method includes an electric heating element that is inserted into the aerosolizable substance. A third heating method heats a hot air extraction airstream to be drawn through the aerosolizable substance by inhalation.

Embodiments disclosed herein are related to an aerosol-generating apparatus of a third class, which is heated by an external heat source. The external heat source may rely on chemical reaction, electricity, or fuel-combustion for generating heat. For example, the external heat source may be a small torch style cigarette lighter that generates a flame. In other examples, the external heat source may include a small coil induction heater, or a resistive heating element.

The aerosol-generating apparatus may include a thermal distribution casing with a multi-layer construction for more uniform heating of a contained therapeutic substance, less reliance on user-technique to produce consistent results, and greater compatibility with a variety of external heat sources. Better heat distribution may also permit any temperature indicators in the apparatus to more accurately signal when a temperature (e.g. of the contained aerosolizable substance) has been attained. In some embodiments, the aerosol-generating apparatus may include separate sensory temperature indicators (e.g. auditory, visual, and/or tactile temperature indicators) which signal when different elements of the apparatus have attained their set point temperatures. The sensory temperature indicators provide for a method of using the apparatus that produces greater accuracy, consistency, and repeatability in the resulting aerosol production all else being equal. In some embodiments, the aerosol-generating apparatus may include a user-adjustable flow control valve that allows the user to tune the flow rate of air through the apparatus.

Figure 2:
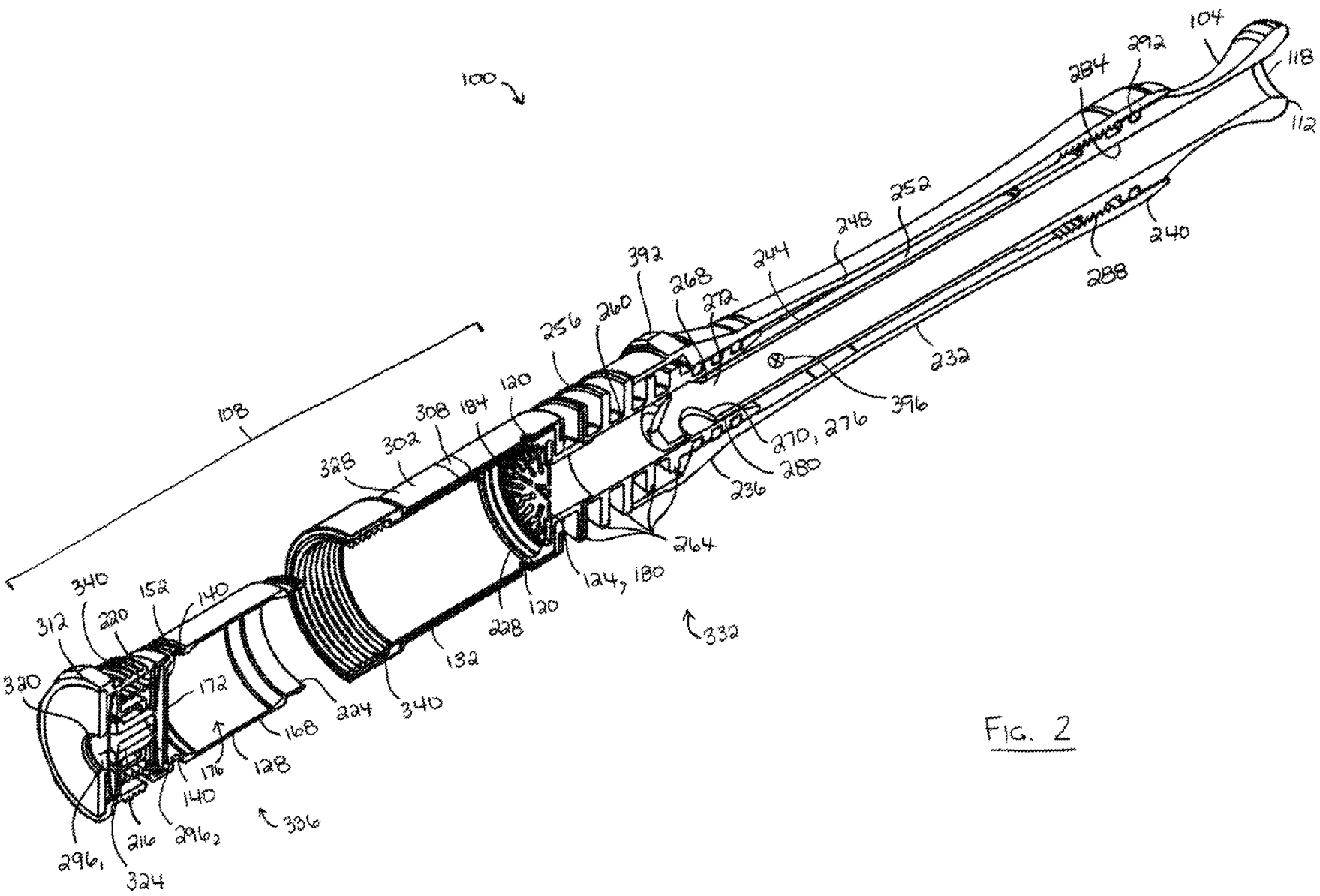
FIG. 2 is a cross-sectioned disassembled view of the apparatus of FIG. 1.

FIGS. 1-2 show an aerosol-generating apparatus 100 in accordance with an embodiment. As shown, apparatus 100 may include a mouthpiece 104 downstream of an aerosolizing thermal reactor 108. A user may deposit an aerosolizable substance (e.g. dried plant product) into aerosolizing thermal reactor 108, apply heat to aerosolizing thermal reactor 108 with an external heat source (e.g. flame or coil induction heater) to aerosolize the contained aerosolizable substance, and inhale through mouthpiece 104 to draw the aerosol into the user's lungs.

Mouthpiece 104 may have any configuration suitable to interface with the user's mouth for purpose of inhaling aerosol generated by apparatus 100. As shown, mouthpiece 104 may have a proximal end 112 with an inhalation outlet 118. A user may partially or fully seal their mouth (e.g. their lips) to mouthpiece 104 while inhaling so that the inhalation pulls gas through aerosolizing thermal reactor 108 whereby generated aerosol is drawn into the user's lungs.

Mouthpiece 104 have any suitable construction. For example, mouthpiece 104 may be rigid or flexible. In some embodiments, mouthpiece 104 may be rigid and made of metal, such as for example, stainless steel. This may make mouthpiece 104 robust and easy to clean, as some aerosols may deposit particles on mouthpiece 104 with usage. In some embodiments, mouthpiece 104 may be flexible. For example, mouthpiece 104 may be made of silicone rubber.

Mouthpiece 104 may be permanently connected to apparatus 100 or removably connected to apparatus 100. A permanently connected mouthpiece 104 may ensure a reliably fluid tight seal between mouthpiece 104 and apparatus 100 so that a user's inhalation suction is efficiently applied. A removably connected mouthpiece 104 may allow mouthpiece 104 to be removed for cleaning, repair, or replacement.

Aerosolizing thermal reactor 108 may include an air inlet 120 (FIG. 4) upstream of an air outlet 124 (FIG. 5), an aerosolizable substance chamber 128 for holding an aerosolizable substance, and a thermal distribution casing 132 surrounding the aerosolizable substance chamber 128. The aerosolizable substance chamber 128 is located downstream of reactor air inlet 120 and upstream of reactor air outlet 124 such that air entering at reactor air inlet 120 may be drawn through aerosolizable substance chamber 128 (e.g. by a user's inhalation at mouthpiece 104) and exit aerosolizing thermal reactor 108 through reactor air outlet 124 towards mouthpiece 104.

Figure 3:
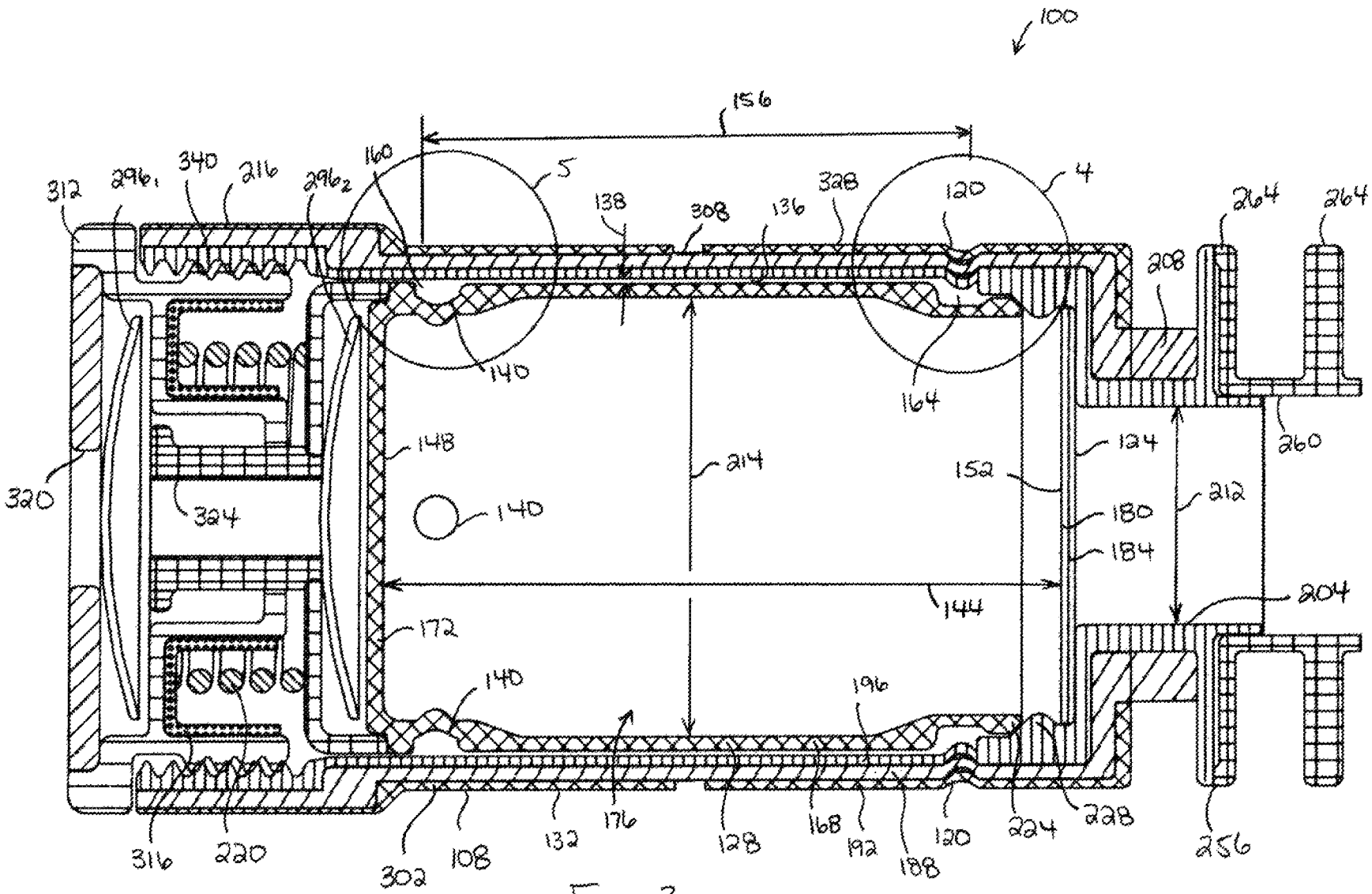
FIG. 3 is a cross-sectional view taken along line 3-3 in FIG. 1.
Figure 4:
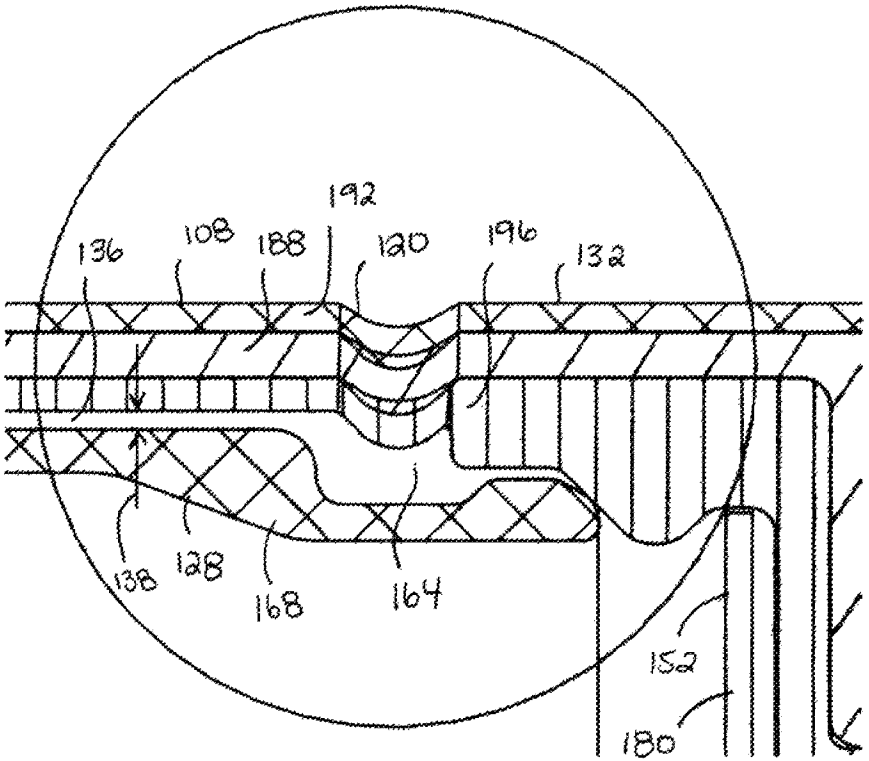
FIG. 4 is an enlargement of region 4 in FIG. 3.
Figure 5:
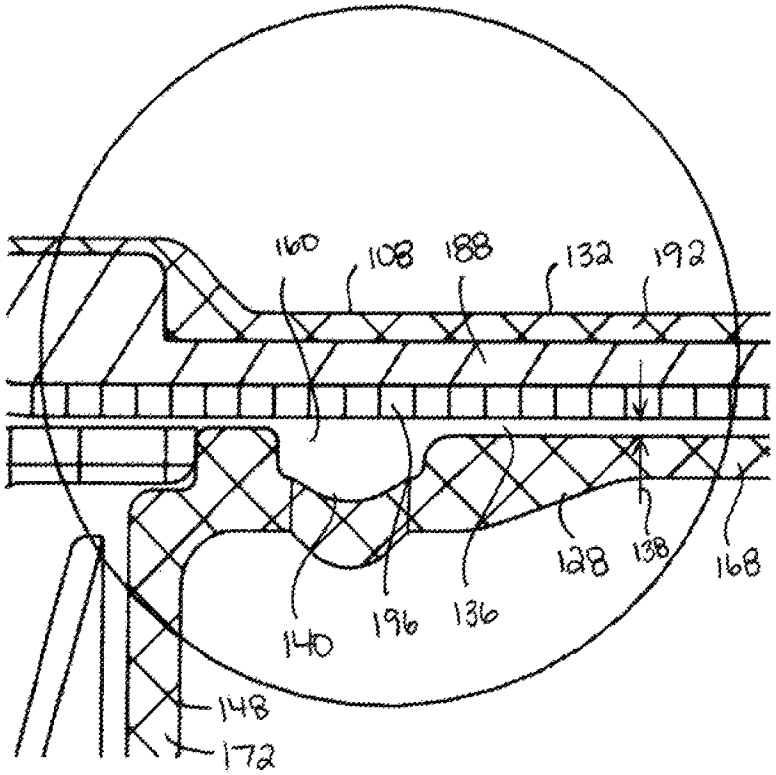
FIG. 5 is an enlargement of region 5 in FIG. 3.

Referring to FIGS. 3-5, aerosolizing thermal reactor 108 may include an air preheating passage 136 located downstream of reactor air inlet 120 and upstream of the aerosolizable substance chamber 128. As shown, air preheating passage 136 may be defined by an air gap between aerosolizable substance chamber 128 and thermal distribution casing 132.

Air preheating passage 136 may have any suitable transverse width 138. In some embodiments, transverse width 138 may be 0.005 to 0.125 inches. For example, transverse width 138 may be 0.005 to 0.010 inches to contribute to a compact (e.g. pocketable) form factor for apparatus 100.

In use, a user may heat aerosolizing thermal reactor 108, such as by touching a flame to aerosolizing thermal reactor 108. Afterwards, the user may inhale from apparatus 100 whereby ambient air (i.e. air from the room or environment in which apparatus 100 resides) is drawn into aerosolizing thermal reactor 108 through reactor air inlet 120 and travels through air preheating passage 136 before entering aerosolizable substance chamber 128. Within air preheating passage 136, the air stream is heated by contact with thermal distribution casing 132 before entering aerosolizable substance chamber 128. Preheating the air stream may mitigate the air stream substantially cooling the contained substance, which may slow or stop the contained substance from aerosolizing. In some cases, the air stream may be preheated to a temperature greater than a temperature of the substance within chamber 128 so that the air stream heats the contained substance, thereby accelerating its aerosolization. Alternative embodiments do not have an air preheating passage 136.

In some embodiments, air preheating passage 136 may surround aerosolizable substance chamber 128. For example, air preheating passage 136 may be substantially annular in cross-section as shown. As used herein and in the claims, the term "annular" means ring shaped, such as for example a circular ring shape, rectangular ring shape, triangular ring shape, or another regular or irregularly shaped ring.

By surrounding aerosolizable substance chamber 128, air preheating passage 136 may provide thermal conduction insolation between aerosolizable substance chamber 128 and thermal distribution casing 132. That is, air preheating passage 136 may substantially inhibit conductive heat transfer from thermal distribution casing 132 to aerosolizable substance chamber 128. Therefore, heat transfer from thermal distribution casing 132 to aerosolizable substance chamber 128 may primarily occur by radiation and convection. This may permit heat applied at one point on thermal distribution casing 132 (e.g. the point where a user touches a flame) to circumferentially and longitudinally spread about thermal distribution casing 132 by conduction. In turn, the heat (now evenly distributed by conduction) may transfer by radiation and convection to aerosolizable substance chamber 128. Accordingly, aerosolizable substance chamber 128 may receive heat that is more evenly circumferentially and longitudinally distributed, all else being equal. This may mitigate hotspots forming on aerosolizable substance chamber 128, which might otherwise cause the contained substance to heat unevenly. For example, hotspots on aerosolizable substance chamber 128 may cause portions of the contained substance in contact with the hotspot to burn, while other portions of the contained substance have not reached an efficient aerosolization temperature.

By heating aerosolizable substance chamber 128 more evenly (i.e. circumferentially and longitudinally), the contained substance may heat more uniformly, such that most or all of the contained substance can be heated to an efficient aerosolization temperature without any portion of the contained substance burning.

Still referring to FIGS. 3-5, air preheating passage 136 may extend longitudinally from reactor air inlet 120 to aerosolizable substance chamber air inlet 140. In some embodiments, air preheating passage 136 may include a plurality of circumferentially distributed (e.g. circumferentially spaced apart) air inlets 120. As shown, each of the plurality of reactor air inlets 120 may deliver ambient air into air preheating passage 136. An advantage to having a plurality of circumferentially distributed reactor air inlets 120 is that it may result in a more even circumferential distribution of the air stream as it flows through air preheating passage 136. A similar effect may be provided by an annular reactor air inlet. Either way, a more even air stream distribution may contribute to a more even circumferential distribution of radiative and convective heat transfer between thermal distribution casing 132 and aerosolizable substance chamber 128, which may lead to more uniform heating of the contained substance as described above. Alternative embodiments have a single reactor air inlet that does not extend circumferentially about thermal distribution casing 132.

Alternatively or in addition to having a plurality of circumferentially distributed reactor air inlets 120 (or an annular reactor air inlet), aerosolizable substance chamber 128 may include a plurality of circumferentially distributed chamber air inlets 140 (or an annular chamber air inlet), which may promote a more even circumferential distribution of the air stream as it flows through air preheating passage 136 and enters aerosolizable substance chamber 128. This may provide more uniform heating of the contained substance as described above Alternative embodiments have a chamber air inlet that does not extend circumferentially about aerosolizable substance chamber 128.

In the illustrated example, there are both (i) a plurality of circumferentially distributed reactor air inlets 120 and (ii) a plurality of circumferentially distributed chamber air inlets 140. This combination of (i) and (ii) may promote the circumferential distribution of the air flow along substantially an entire length of air preheating passage 136.

Aerosolizing thermal reactor 108 may have any number of reactor air inlets 120. For example, aerosolizing thermal reactor 108 may have one air inlet 120 (e.g. a bored air inlet, or an annular air inlet), or a plurality of air inlets 120 (e.g. 2-20 air inlets). The illustrated example includes four reactor air inlets 120, which are evenly circumferentially distributed (e.g. each 90 degree section includes one reactor air inlet 120). Alternative embodiments may have an uneven circumferential distribution of reactor air inlets 120. Further, aerosolizable substance chamber 128 may have any number of chamber air inlets 140. For example, aerosolizable substance chamber 128 may have one air inlet 140 (e.g. a bored air inlet, or an annular air inlet), or a plurality of air inlets 140 (e.g. 2-20 air inlets). The illustrated example, includes four chamber air inlets 140, which are evenly circumferentially distributed (e.g. each 90 degree section includes one chamber air inlet 140).

Still referring to FIG. 3, aerosolizable substance chamber 128 may have a chamber longitudinal length 144 measured from a chamber distal end 148 to a chamber proximal end 152. Further, air preheating passage 136 may have a passage longitudinal length 156 from a passage distal end 160 to a passage proximal end 164. In some embodiments, passage longitudinal length 156 may be at least 50% of chamber longitudinal length 144, and more preferably at least 70% of chamber longitudinal length 144 as shown. In the illustrated example, passage longitudinal length 156 is at least 90% of chamber longitudinal length 144. Providing a relatively long longitudinal passage length 144 relative to chamber longitudinal length 144 can allow air preheating passage 136 to (i) isolate a larger portion of aerosolizable substance chamber 128 from heat conduction from thermal distribution casing 132, and (ii) promote a more even longitudinal distribution of radiative and convective heat transfer from thermal distribution casing 132 to aerosolizable substance chamber 128.

Aerosolizable substance chamber 128 may have a chamber outer wall 168 that extends between chamber distal end 148 and chamber proximal end 152. In some embodiments, at least 50% of the surface area of chamber outer wall 168 may border air preheating passage 136 (i.e. air within air preheating passage 136 may have contact with at least 50% of the surface area of chamber outer wall 168). For example, at least 70% of the surface area of chamber outer wall 168 may border air preheating passage 136 as shown. In the illustrated example, at least 80% of the surface area of chamber outer wall 168 borders air preheating passage 136. Sizing air preheating passage 136 to border a relatively large portion of the surface area of chamber outer wall 168 can allow air preheating passage 136 to (i) isolate a larger portion of aerosolizable substance chamber 128 from heat conduction from thermal distribution casing 132, and (ii) promote a more even area distribution of radiative and convective heat transfer from thermal distribution casing 132 to aerosolizable substance chamber 128.

As shown, chamber outer wall 168 may have an annular shape. Aerosolizable substance chamber 128 may further include a distal end wall 172 connected to chamber outer wall 168 at chamber distal end 148. Together, chamber outer wall 168 and chamber distal end wall 172 may bound a chamber inner volume 176 in which an aerosolizable substance may be contained. In some embodiments, chamber outer wall 168 and chamber distal end wall 172 may be air impermeable, except for chamber air inlet(s) 140 if formed in one of these walls 168, 172.

Aerosolizable substance chamber 128 may have an aerosol outlet 180 downstream of chamber air inlet(s) 140 and chamber inner volume 176. As shown, aerosol outlet 180 may be located proximate (e.g. at or near to) chamber proximal end 152. Chamber inlet(s) 140 may be located proximate (e.g. at or near to) chamber distal end 148. In some embodiments, aerosol outlet 180 may include an air permeable screen 184. Outlet screen 184 may inhibit the non-aerosolized portions of the substance contained in aerosolizable substance chamber 128 from flowing downstream out of chamber 128 through outlet screen 184. This may mitigate a user inhaling the non-aerosolized portions of the substance, which could be unpleasant or even harmful to the user. Screen 184 may have any design suitable to impede the egress of non-aerosolized portions of the contained substance. For example, screen 184 may include a plate with a plurality of perforations as shown and/or a mesh material.

Thermal distribution casing 132 may have any construction suitable for receiving heat from an external heat source and transferring that heat to the aerosolizable substance chamber 128. In some embodiments, thermal distribution casing 132 may include at least one layer of metal material. As used herein and in the claims, a "metal material" encompasses at least pure metals (e.g. copper) and metal alloys (e.g. stainless steel).

In some embodiments, thermal distribution casing 132 may be constructed with a laminate material having at least three metal layers. As shown, thermal distribution casing 132 may include at least a metal middle layer 188, a metal outer layer 192, and a metal inner layer 196. Each metal layer 188, 192, 196 is made of a metal material. In some embodiments, the metal material of the middle metal layer 188 has a thermal conductivity of at least double the thermal conductivity of the metal materials of each of the outer and inner layers 192, 196. This can allow the metal material of the metal middle layer 188 to be selected based primarily on its thermal conductivity, while the metal material of outer and inner layers 192, 196 may be selected based on other factors such as for example, hardness, corrosion resistance, medical grading and food safety (e.g. biocompatibility), induction heating compatibility, melting point, aesthetics, and cost.

In some embodiments, middle layer 188 is made of a high thermal conductivity metal material (e.g. thermal conductivity greater than 200 W/m·K). As examples, middle layer 188 may be made of copper (thermal conductivity of about 400 W/m·K), aluminum (thermal conductivity of about 220 W/m·K), gold (thermal conductivity of about 315 W/m·K), or silver (thermal conductivity of about 410 W/m·K), or an alloy containing one or more of these materials. In a preferred embodiment, middle layer 188 may be made of copper, as it has among the highest thermal conductivities of readily available metals, it has a lower cost than precious metals such as gold and silver, it is compatible with induction heating (whereas aluminum is not), and it has social acceptability (e.g. as compared to aluminum, which has some residual stigma from a decades-old myth that it can cause Alzheimer's). However, aluminum has good thermal conduction and has low cost as compared to copper, which make it suitable where induction heating is not contemplated (or where compatibility with induction heating relies on outer or inner layers 192, 196), and in regions where aluminum has social acceptance.

As an example, outer layer 192 may be made of stainless steel, which is characterized by its durability, hardness, strength, and corrosion resistance. This may be desirable as outer layer 192 may be directly exposed to an external heating source (e.g. flame, resistance heater, or induction heater), the elements (e.g. rain or snow), handling (e.g. by hands, cases, tables, luggage, and bags), and mishandling (e.g. drops, bangs, and scrapes).

In some embodiments, one of layers 188, 192, 196 is made of a ferromagnetic metal material, which may provide strong compatibility with induction heating. For example, outer layer 192 may be made of a ferromagnetic steel, such as martensitic steel, which is strongly compatible with induction heating. Alternative embodiments have none of layers 188, 192, 196 being made of ferromagnetic metal material.

As an example, inner metal layer 196 may be made of stainless steel. In some embodiments, inner metal layer 196 may be made of an austenitic steel, such as 316 austenitic steel, which may have medical grading (e.g. biocompatibility) and meet food safety standards. This may contribute to apparatus 100 being certified as a medical device by medical organizations, medical colleges, and/or insurance companies.

Still referring to FIG. 3, in some embodiments aerosolizing thermal reactor 108 may include a flow constriction conduit 204 immediately downstream of chamber aerosol outlet 180. Flow constriction conduit 204 may be defined at least in part by a high thermal conductivity metal material (e.g. thermal conductivity greater than 200 W/m·K) thermo-conductively coupled to thermal distribution casing 132. For example, flow constriction conduit 204 may be integrally formed with a layer (e.g. middle layer 188) of thermal distribution casing 132. In some embodiments, conduit sidewall 208 of flow constriction conduit 204 may include at least metal middle layer 188. In the illustrated example, conduit sidewall 208 includes metal middle layer 188 and metal inner layer 196. For example, metal middle layer 188 may provide high thermal conductivity and metal inner layer 196 may provide medical grading and food safety compliance as described above.

Flow constriction conduit 204 may act to impart additional heat to an aerosol exiting aerosol outlet 180. This may improve the bioavailability of the aerosol when inhaled into the user's lungs. For example, the constriction (e.g. reduced cross-sectional flow area) of flow constriction conduit 204 may promote aerosolized particles (e.g. liquid particles) to contact conduit sidewall 208. Conduit sidewall 208 may have a temperature higher than chamber outer wall 168, because metal middle layer 188 may efficiently receive heat conductively from thermal distribution casing 132 (which has been heated directly by an external heat source, e.g. flame, electric heater, or induction heater). Thus, flow constriction conduit 204 may add heat to aerosolized particles that contact conduit sidewall 208, and the added heat may cause those particles to break apart into smaller particles whereby the bioavailability of the aerosol particles (when inhaled into the user's lungs) increases. In the result, flow constriction conduit 204 may heighten the therapeutic effect of the aerosol with each inhalation, and may reduce the quantity of aerosolizable substance required to achieve a desired therapeutic effect (e.g. pain relief). This may lead to significant cost savings for users by reducing their consumption rate of the aerosolizable substance, which may cost tens of dollars or more (USD) per gram. Alternative embodiments do not have a flow constricting conduit 204.

Cannabis is an example of an aerosolizable substance that may be used with apparatus 100. Cannabis may be heated to generate an aerosol containing its volatile chemicals, known as cannabinoids (such as THC and CBD). A dried cannabis plant has an ignition temperature of around 225° C., and therefore the cannabis plant matter inside aerosolizable substance chamber 128 should not be heated to above 225° C. to avoid burning. However, the cannabinoids have boiling points at atmospheric pressure of around 400° C. The flow constriction conduit 204 may act to raise the temperature of the exiting aerosol (containing cannabinoid particles) to above the plant ignition temperature, and towards (e.g. to closer to or even exceeding) their boiling points whereby the particle sizes of the cannabinoids may be substantially reduced, increasing their bioavailability when inhaled into the user's lungs.

The thermal conduction isolation of aerosolizable substance chamber 128 from thermal distribution casing 132 creates a thermal lag whereby the thermal distribution casing 132 can be heated to above the plant ignition temperature without raising the aerosolizable substance chamber 128 above the plant ignition temperature. The flow constriction conduit 204 may be thermo-conductively coupled to thermal distribution casing 132 (e.g. by including an extension of metal inner layer 196 in conduit sidewall 208) so that the flow constriction conduit 204 may too rise above the plant ignition temperature. The flow constriction conduit 204 has direct contact with the aerosol exiting aerosolizable substance chamber 128, allowing flow constriction conduit 204 to raise the temperature of the exiting aerosol above the plant ignition temperature independently of the aerosolizable substance remaining in the aerosolizable substance chamber 128.

As shown, flow constriction conduit 204 may have a diameter 212 (measure transverse to the flow direction), and aerosolizable substance chamber 128 may have a diameter 214 (measure transverse to the flow direction). Conduit diameter 212 may be less than 50% of chamber diameter 214, as shown. This constriction may promote contact between particles in the aerosol exiting chamber 128 and conduit sidewall 208.

In some embodiments, a minimum cross-sectional area (measured transverse to the flow direction) of flow constriction conduit 204 may be less than 25% of a maximum cross-sectional area (measured transverse to the flow direction) of aerosolizable substance chamber 128. This constriction may promote contact between particles in the aerosol exiting chamber 128 and conduit sidewall 208.

Referring to FIGS. 2-3, in some embodiments aerosolizing thermal reactor 108 comprises a reactor distal end portion 216 with a thermal break 220 that contributes thermal conduction isolation between thermal distribution casing 132 and aerosolizable substance chamber 128. Thermal break 220 may impede thermal conduction between thermal distribution casing 132 and aerosolizable substance chamber distal end 148. For example, thermal break 220 may be composed of a material (e.g. rubber or stone) with very low thermal conductivity (e.g. thermal conductivity of less than 2 W/m·K). However, rubber may be ineffective for many applications since it has a low melting point of around 180° C., and therefore may melt before the aerosolizable substance in chamber 128 reaches an effective aerosolization temperature (e.g. 200° C.). More preferably, thermal break 220 may create thermo-conductive impedance by having a small cross-sectional area (in the direction of heat transfer towards chamber distal end 148). For example, thermal break 220 may have a total cross-sectional area in the direction of heat transfer towards chamber distal end 148 of less than 20 $mm^2$). In some examples, thermal break 220 may comprise a thin pin or thin walled pipe. In the illustrated example, thermal break 220 comprises a spring. Alternative embodiments do not include a thermal break 220.

Spring 220 may be a compression spring that biases aerosolizable substance chamber 128 in the proximal direction. As shown, the bias may urge a proximal end 224 of chamber outer wall 168 against an alignment abutment 228 (e.g. an inward protrusion, such as an inward rib as shown) of thermal distribution casing 132. Alignment abutment 228 may help maintain aerosolizable substance chamber 128 aligned within thermal distribution casing 132 to maintain an air gap between them, which serves as an air preheating passage 136 as described above. Alternative embodiments do not include an alignment abutment 228.

Referring to FIGS. 1-2, apparatus 100 may include a handgrip 232 extending longitudinally between mouthpiece 104 and aerosolizing thermal reactor 108. As shown, handgrip 232 may have a proximal end 236 connected to (e.g. directly connected to) mouthpiece 104, and a distal end 240 connected (e.g. directly connected to) aerosolizing thermal reactor 108. Handgrip 232 may also provide fluid communication between aerosolizing thermal reactor 108 and mouthpiece 104. As shown, handgrip 232 may be located downstream of aerosolizing thermal reactor 108 and upstream of mouthpiece 104. In use, a user may hold apparatus 100 by grasping handgrip 232, during and between inhalations and heating steps. Alternative embodiments do not include a handgrip 232.

As shown, in some embodiments handgrip 232 may have a hollow-core construction including a handgrip inner conduit 244 inside a handgrip outer shell 248, with an annular air gap 252 extending between the inner conduit 244 and outer shell 248. Hot aerosols generated by aerosolizing thermal reactor 108 may flow through handgrip inner conduit 244 to mouthpiece 104. Annular air gap 252 may be fluidly disconnected from handgrip inner conduit 244 so that substantially none of the generated aerosols flows through annular air gap 252. As used herein and in the claims, reference to "substantially none" of the generated aerosols flows through annular air gap 252 encompasses embodiments where, due to the imperfect seal, e.g. as provided by a sliding connection (which may be referred to as a 'slip fit'), a small amount (e.g. less than 1%) of the generated aerosols flows through annular air gap 252. This allows annular air gap 252 to provide thermal insulation between handgrip outer shell 248 and handgrip inner conduit 244. This may mitigate the hot aerosols, which flow through handgrip inner conduit 244, heating handgrip outer shell 248 to the point that it becomes uncomfortable or burns the user's hand. Thus, annular air gap 252 may help maintain handgrip outer shell 248 at a comfortable temperature for users' hands. Alternative embodiments have a handgrip 232 without a hollow-core construction. For example, handgrip 232 may include inner conduit 244 but no outer shell 248.

Still referring to FIGS. 1-2, apparatus 100 may include a thermal break 256 positioned between aerosolizing thermal reactor 108 and handgrip distal end 240. Thermal break 256 may have any configuration suitable to impede heat transfer between thermal distribution casing 132 and handgrip outer shell 248, and provide fluid communication between aerosolizing thermal reactor 108 and handgrip inner conduit 244. In the illustrated example, thermal break 256 is formed as a conduit 260 with external fins 264. Thermal break conduit 260 provides fluid communication between aerosolizing thermal reactor 108 and handgrip inner conduit 244. Thermal break fins 264 provide thermal mass to slow temperature rise, and surface area to promote heat dissipation. The effect of thermal break 256 is that it may mitigate heat from aerosolizing thermal reactor 108—and particularly thermal distribution casing 132—from heating handgrip outer shell 248 to a temperature that is uncomfortable or burns the user's hand. Alternative embodiments do not include a thermal break 256. For example, handgrip distal end 240 may be directly connected to aerosolizing thermal reactor 108.

Together, thermal break 256 and annular air gap 252 may cooperatively mitigate aerosolizing thermal reactor 108 and the exiting hot aerosol from heating handgrip outer shell 248 to a temperature that is uncomfortable or burns the user's hand.

Referring to FIG. 2, in some embodiments, apparatus 100 may include a manually user-adjustable flow control valve 268. Flow control valve 268 may be located downstream of chamber aerosol outlet 180 and upstream of mouthpiece 104. For example, flow control valve 268 may be located proximate (e.g. at or near) an aerosol inlet 270 to handgrip 232 (e.g. inlet to handgrip inner conduit 244). A user may manually (i.e. by hand) adjust the position of flow control valve 268 to change a flow constriction imparted by the flow control valve 268. For example, a user may manually adjust the position of flow control valve 268 between a fully open position at which flow control valve 268 provides a minimum of impedance to aerosol flow towards mouthpiece 104, and a fully closed position at which flow control valve 268 provides a maximum of impedance to aerosol flow towards mouthpiece 104. For clarity, the "fully open" position may still provide some impedance to aerosol flow towards mouthpiece 104, and the "fully closed" position may still allow aerosol flow towards mouthpiece 104. Alternative embodiments do not include flow control valve 268.

In use, a user may manually select the position of flow control valve 268 to control the flow rate of gas through apparatus 100 and calibrate the generation of aerosol from the contained aerosolizable substance. For example, a user may move the position of flow control valve 268 towards the fully closed position to slow the flow rate, whereby (i) the air stream will have a longer residency time in air preheating passage 136 to attain a higher temperature before entering aerosolizable substance chamber 128, and (ii) the air stream will have a longer residency time in aerosolizable substance chamber 128 to convectively heat the contained substance before the generated aerosol exits through aerosol outlet 180; and vice versa. Thus, flow control valve 268 allows users aerosolizing different substances and with different lung-suction capacity to calibrate the flow rate through apparatus 100 and achieve predictable and consistent results tuned to their liking.

Figure 7:
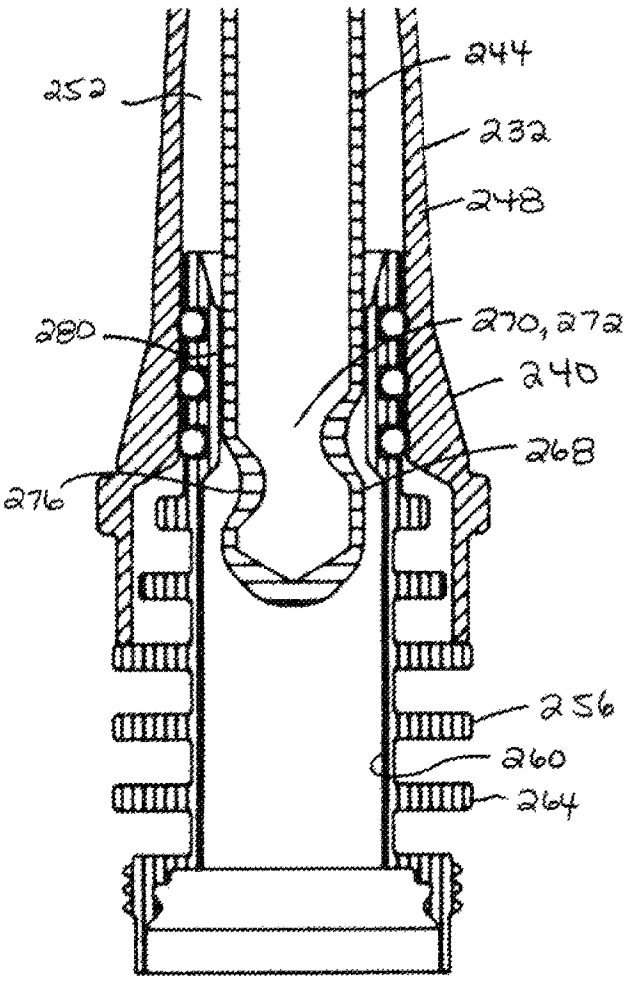
FIG. 7 is a cross-sectional view of the flow control valve of FIG. 6, in a fully open position, in accordance with an embodiment.
Figure 6:
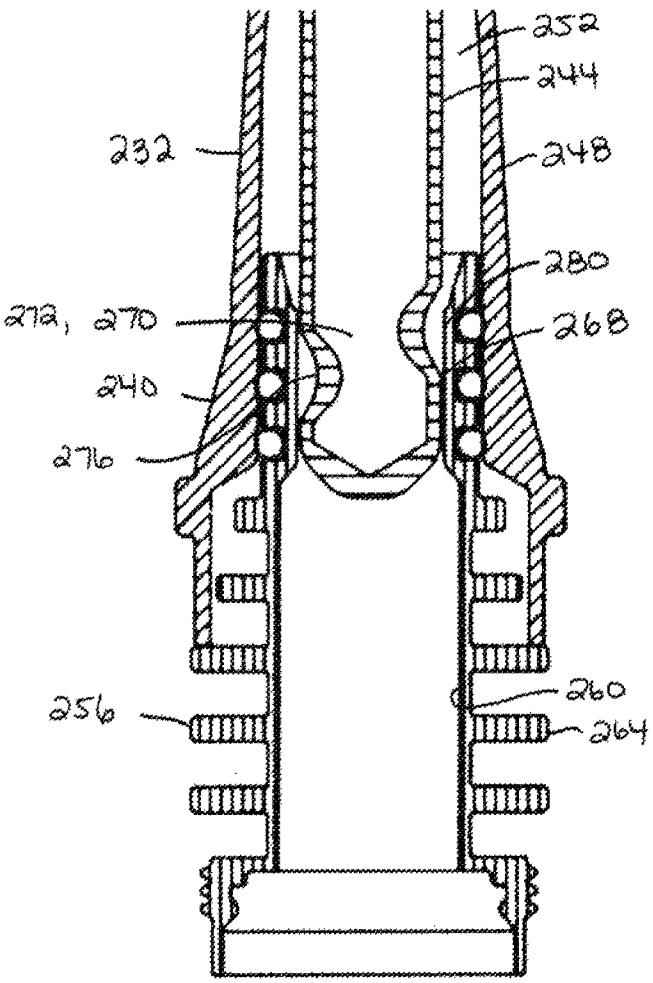
FIG. 6 is a cross-sectional view of a flow control valve in a fully closed position.

Flow control valve 268 may have any configuration suitable for providing manual user control over the flow rate through apparatus 100. Referring to FIGS. 2, 6, and 7, in the illustrated example, flow control valve 268 is connected to a distal end 272 of handgrip inner conduit 244. As shown, flow control valve 268 may include one or more inlets 276 that are movable longitudinally relative to a shell 280 to vary the degree to which shell 280 closes inlet(s) 276. FIG. 6 shows flow control valve 268 in a fully closed position, with shell 280 fully closing inlets 276. FIG. 7 shows flow control valve 268 in a fully open position, with shell 280 providing minimal obstruction to flow into inlets 276.

Flow control valve 268 may be movable between positions in any manner. In some embodiments, flow control valve inlets 276 may move longitudinally (e.g. in the distal and proximal directions) relative to flow control valve shell 280 between the fully closed position (FIG. 6) and fully open position (FIG. 7). As shown, a proximal end 284 of handgrip inner conduit 244 may be connected to (e.g. rigidly connected to) mouthpiece 104 and may be connected by threads 288 to handgrip outer shell 248. This may permit mouthpiece 104 to be manually rotated relative to handgrip outer shell 248 to longitudinally advance and retract handgrip inner conduit 244 and therefore move flow control valve inlets 276 longitudinally relative to flow control valve shell 280 between the fully closed and fully open positions (and any position in between).

As shown, handgrip annular air gap 252 may remain substantially fluidly sealed from aerosol outlet 180 at all positions of flow control valve 268 (i.e. at the fully open position, fully closed position, and all positions in between) (i.e. substantially none of the generated aerosols flows through annular air gap 252). This may substantially prevent aerosol from entering annular air gap 252 where the aerosol may (i) uncomfortably heat handgrip outer shell 248, and (ii) unhygienically deposit aerosol particles inside annular air gap 252 where they may be difficult to clean. As shown in FIG. 2, in some embodiment, handgrip 232 may include a seal 292 (e.g. O-ring) that seals handgrip outer shell 248 to handgrip inner conduit 244 or to mouthpiece 104. In the illustrated embodiment, seal 292 is located proximal of handgrip threads 288.

Reference is now made to FIG. 3. In some embodiments, apparatus 100 may include one or more sensory temperature indicators 296. As used herein and in the claims, a "sensory temperature indicator" is a device that generates an auditory, visual, or tactile indication perceptible by a human user to indicate when a set point temperature has been crossed (e.g. its temperature has risen above the set point temperature, fallen below the set point temperature, or both). Each sensory temperature indicator 296 is thermally coupled to a portion of apparatus 100, and has a set point temperature (associated with that apparatus portion) at which the sensory temperature indicator generates an audible alert (e.g. a snap, pop, click, or ringing), a visual alert (e.g. color change, shape change, inversion of concavity, or visible protrusion), or a tactile alert (e.g. vibration). In some embodiments, a sensory temperature indicator 296 may be a bimetallic snap disc. When a bimetallic snap disc crosses (e.g. rises above, or falls below) its set point temperature, it generates an audible snap and a tactile vibration. In some embodiments, a bimetallic snap disc may have attached (e.g. laser welded) to it a protrusion (e.g. pin) that becomes visible or hidden (e.g. protrudes through or recesses from an aperture in apparatus 100) when it crosses its set point temperature. Alternative embodiments do not include an sensory temperature indicator 296.

In some embodiments, sensory temperature indicators 296 may be associated with portions of aerosolizing thermal reactor 108 in order to guide the user in deciding (i) how long to apply heat to thermal distribution casing 132, (ii) when aerosolizable substance chamber 128 has attained a target temperature, and/or (iii) when aerosolizable substance chamber 128 has fallen below a target temperature.

In some embodiments, aerosolizing thermal reactor 108 includes an sensory casing temperature indicator 2961 thermally coupled to thermal distribution casing 132, and an sensory chamber temperature indicator 2962 thermally coupled to aerosolizable substance chamber 128. Alternative embodiments include only one of sensory temperature indicators 2961 and 2962.

Sensory casing temperature indicator 2961 may have a set point temperature associated with a target temperature for thermal distribution casing 132. Thus, when a user is applying heat to thermal distribution casing 132, sensory casing temperature indicator 2961 may generate an alert to notify the thermal distribution casing 132 has reached a target temperature. Depending on the prescribed heating regimen/procedure, after thermal distribution casing 132 reaches the target temperature, the user may cease applying heat. Preferred embodiments may include an sensory casing temperature indicator 2961 with a thermal distribution casing 132 made with a laminate material to more evenly circumferentially and longitudinally distribute heat from the point or region where heat is applied to thermal distribution casing 132. This combination may synergistically allow casing temperature indicator 2961 to more accurately indicate the temperature of thermal distribution casing 132 irrespective of whether heat is applied to thermal distribution casing 132 at locations close to or farther away from sensory temperature indicator 2961. This may allow apparatus 100 to generate more consistent results irrespective of the user's skill or technique (e.g. application of heat to a prescribed location, and continual rotation of apparatus about longitudinal axis 304 while applying heat).

Alternatively or in addition to the laminate construction, apparatus 100 may include a visual indicium 308 of where the user is to apply heat to thermal distribution casing 132. Visual indicium 308 may have any configuration suitable to clearly indicate to the user where to apply heat to thermal distribution casing 132 in order to generate targeted results (e.g. even heating, and accurate temperature alerting by sensory casing temperature indicator 2961). For example, visual indicium 308 may include a piece (e.g. band) of material attached to an exterior of thermal distribution casing 132. In other embodiments, visual indicium 308 may include several pieces (e.g. bands) of attached material that identify a region where the user should apply heat. Instead of attaching material to thermal distribution casing 132, visual indicium 308 may be formed by an engraving on an exterior of thermal distribution casing 132. As shown in FIG. 3, in the illustrated example, visual indicium 308 is formed by removing a portion of metal outer layer 192, which exposes the underlying metal middle layer 188. In this case, visual indicium 308 may be particularly distinct where metal outer layer 192 and metal middle layer 188 are different colors. For example, metal outer layer 192 may be painted, or the metal material of metal outer layer 192 (e.g. stainless steel) may be a different natural color from the natural color of metal middle layer 188 (e.g. copper or gold). In alternative embodiments, apparatus does not have a visual indicium 308.

Sensory chamber temperature indicator 2962 may have a set point temperature associated with a target temperature for aerosolizable substance chamber 128. Thus, when a user is applying heat to thermal distribution casing 132 (e.g. according to a prescribed heating regimen), sensory chamber temperature indicator 2962 may generate an alert to notify the user when aerosolizable substance chamber 128 has reached a target temperature. Depending on the prescribed heating regimen, after aerosolizable substance chamber 128 reaches the target temperature, the user may cease applying heat and inhale the generated aerosol.

Sensory temperature indicator(s) 296 may be positioned anywhere in or on apparatus 100 suitable for each sensory temperature indicator 296 to notify the user when the associated portion of apparatus 100 has reached a respective target temperature. In the illustrated embodiment, sensory temperature indicators 296 are located within reactor distal end portion 216. As shown, both sensory temperature indicators 296 may be located distally of aerosolizable substance chamber 128.

Sensory chamber temperature indicator 2962 may be positioned in close proximity to (e.g. abutting) chamber distal end 148. For example, sensory chamber temperature indicator 2962 may be positioned between reactor thermal break 220 and chamber distal end 148. This may permit reactor thermal break 220 to provide sensory chamber temperature indicator 2962 with some thermo-conductive isolation from thermal distribution casing 132, so that sensory chamber temperature indicator 2962 may more accurately indicate the temperature of aerosolizable substance chamber 128. As shown, sensory chamber temperature indicator 2962 may be positioned proximal of reactor thermal break 220 and distal of chamber distal end 148.

Sensory casing temperature indicator 2961 may be positioned distally of chamber temperature indicator 2962 adjacent reactor distal end 312. As shown, sensory casing temperature indicator 2961 may be positioned distally of reactor thermal break 220. This may permit sensory casing temperature indicator 2961 to more accurately indicate the temperature of thermal distribution casing 132. In some embodiments, aerosolizing thermal reactor 108 may include additional segment(s) 316 of high thermal conductivity metal (e.g. having a thermal conductivity greater than 200 W/m·K) interior of thermal distribution casing 132. For example, segments 316 may be made of the same material as metal middle layer 188 (provided that thermal distribution casing 132 includes a laminate material with a metal middle layer 188). High thermal conductivity segment(s) 316 may help to conduct heat from thermal distribution casing 132 towards sensory casing temperature indicator 2961 so that sensory casing temperature indicator 2961 may more accurately indicate the temperature of thermal distribution casing 132. Alternative embodiments do not include segments 316.

Still referring to FIG. 3, in some embodiments, aerosolizing thermal reactor 108 includes a sound propagation aperture 320 at reactor distal end 312. Sound propagation aperture 320 may provide an unimpeded passage for sound waves, generated by sensory casing temperature indicator 2961 when it alerts to its set point temperature, out of apparatus 100. This may make sensory casing temperature indicator 2961 louder and clearer to the user (e.g. as compared housing sensory casing temperature indicator 2961 in an enclosed chamber without a sound propagation aperture). As shown, sound propagation aperture 320 may further provide line of sight to sensory casing temperature indicator 2961 from outside of apparatus 100 so that users who are deaf, have poor hearing, or using apparatus 100 in a noisy environment (e.g. a night club or concert hall) may be able to observe a visual change in sensory casing temperature indicator 2961 that may occur when sensory casing temperature indicator 2961 crosses its set point temperature. In this case, sound propagation aperture 320 may be referred to as an "audio-visual propagation aperture" in that it provides an unimpeded passage for sound waves and light from the sensory casing temperature indicator 2961, whereby the user may hear and visually observe auditory and visual alerts generated by the sensory casing temperature indicator 2961. Alternative embodiments include neither a sound propagation aperture 320 nor an audio-visual propagation aperture.

In some embodiments, aerosolizing thermal reactor 108 includes a sound propagation conduit 324 that extends longitudinally from proximate sensory chamber temperature indicator 2962 to proximate the sensory casing temperature indicator 2961. In combination with sound propagation aperture 320, sound propagation conduit 324 may provide a low-impedence passage for sound waves, generated by sensory chamber temperature indicator 2962 when it alerts to its set point temperature, out of apparatus 100. This may make sensory chamber temperature indicator 2962 louder and clearer to the user (e.g. as compared to housing sensory chamber temperature indicator 2962 in an enclosed chamber without a sound propagation conduit). Alternative embodiments do not include a sound propagation conduit 324.

Sensory temperature indicators 296 may have the same or different set point temperatures. For example, the set point temperature of sensory casing temperature indicator 2961 may be equal to or greater than the set point temperature of sensory chamber temperature indicator 2962. The selection of set point temperatures depends on the construction of apparatus 100 including materials used, air flow characteristics, the positioning of sensory temperature indicators 296, and the properties of the aerosolizable substance (e.g. density, specific heat, target aerosolization temperature, moisture content, ignition temperature, etc.) intended for use with apparatus 100.

Referring to FIG. 1, in some embodiments, apparatus 100 may include a fulcrum stand 392 that holds aerosolizing thermal reactor 108 above a horizontal surface (e.g. table) when apparatus 100 is laid horizontally on the horizontal surface. This may mitigate aerosolizing thermal reactor 108 causing heat damage to the surface, and may avoid the need for thermal pads (e.g. silicone pads used to safely support a vaporizer on tables). Alternative embodiments do not include a fulcrum stand 392.

As shown, fulcrum stand 392 may be positioned proximal of aerosolizing thermal reactor 108 and protrude radially outwardly compared to aerosolizing thermal reactor 108. The center of gravity 396 of apparatus 100 may be located proximal of fulcrum stand 392. This allows fulcrum stand 392 to act as a fulcrum when apparatus 100 is laid horizontally on a horizontal surface, whereby apparatus 100 may teeter about fulcrum stand 392. Because center of gravity 396 is located proximal of fulcrum stand 392, portions of apparatus 100 proximal of fulcrum stand 392 will tip downwardly from fulcrum stand 392 towards the horizontal surface, and consequently aerosolizing thermal reactor 108 will tip upwardly from fulcrum stand 392 away from horizontal surface. Thus, fulcrum stand 392 may help prevent aerosolizing thermal reactor 108 from contacting the horizontal surface (e.g. table), and thereby mitigate heat damage caused to the horizontal surface.

In some embodiments, fulcrum stand 392 may be located proximal of thermal break 256. Thermal break 256 may help reduce heat transfer from aerosolizing thermal reactor 108 to fulcrum stand 392. This may help maintain fulcrum stand 392 at a temperature lower than aerosolizing thermal reactor 108, and preferably lower than temperatures that would cause damage to horizontal surfaces (e.g. tables).

In some embodiments, fulcrum stand 392 may be non-circular. This may allow fulcrum stand 392 to inhibit apparatus 100 from rolling off of a horizontal surface that is not perfectly level (e.g. rolling off a table onto the floor). It could be dangerous for apparatus 100, when hot, to roll off a table onto a user's foot or floor, in that it could cause personal injury (burns), surface damage, and even fire (e.g. to a carpet or papers on the floor). In the illustrated example, fulcrum stand 392 is many-sided. For example, fulcrum stand 392 may be 6 sided similar to a 6-sided washer. Alternative embodiments have a fulcrum stand 392 that is circular.

Figure 8:
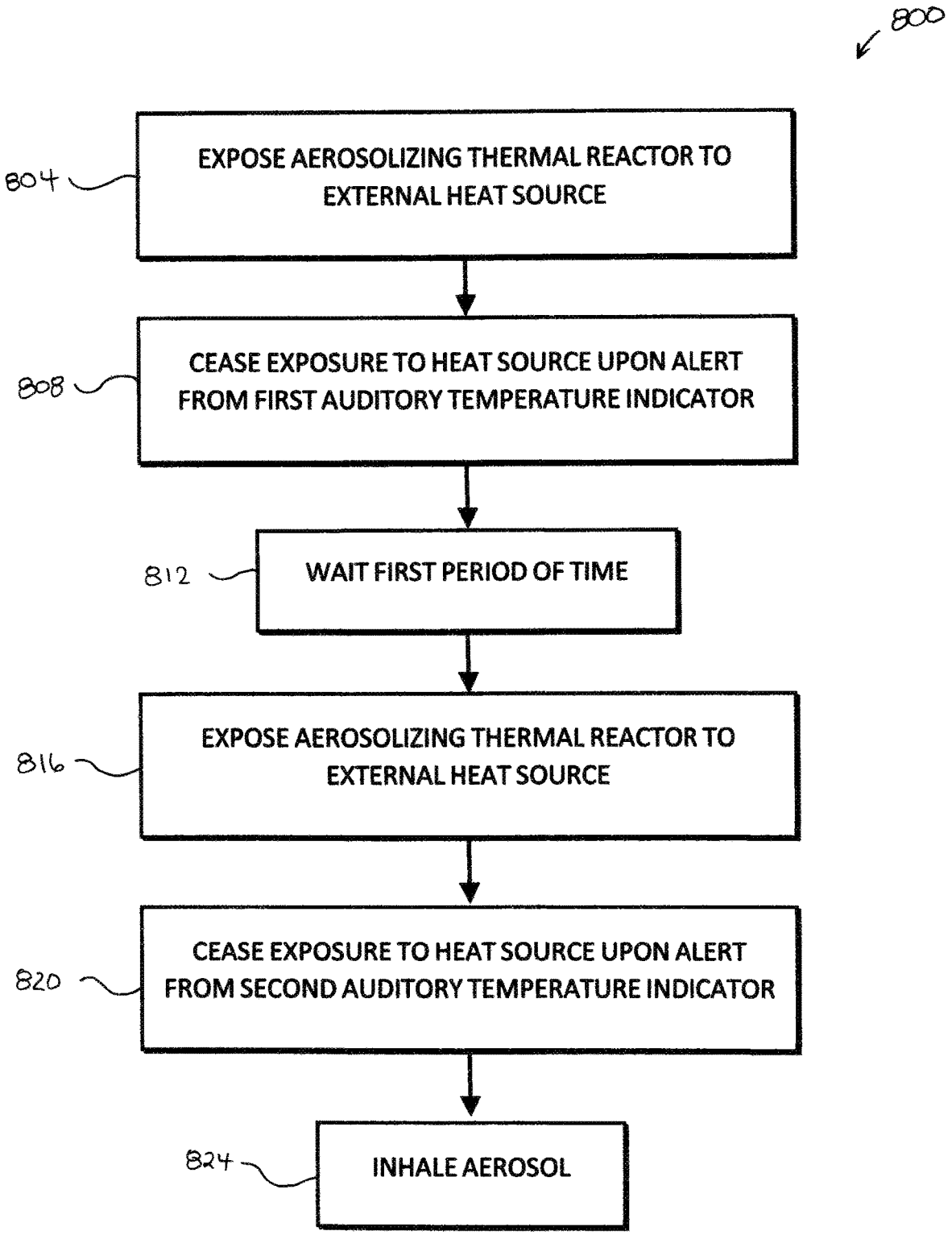
FIG. 8 is a flowchart illustrating a method of generating an aerosol with an aerosol-generating apparatus, in accordance with an embodiment.

A method 800 of using apparatus 100, in accordance with an embodiment, is now described with reference to FIGS. 1, 3, and 8.

At 800, aerosolizing thermal reactor 108 is exposed to heat from an external heat source. In some examples, the external heat source may generate flames, hot electric heating elements, or an inductive field. Thermal distribution casing 132 may be exposed to the heat (e.g. flame, electric heating element, or inductive field) of the external heat source. As used herein and in the claims, "exposure to heat" includes, without limitation, exposure to a high temperature source (e.g. flame or electric heating element) and exposure to heat generating energy (e.g. an inductive field).

Embodiments having a thermal distribution casing 132 with a multi-layer laminate construction may be more accommodating to the use of different types of heat source—e.g. point heat source such as a single flame butane torch lighter, multi-point heat source such as a triple-flame butane torch light, or an area heat source such as an inductive heater—because of its capacity to evenly distribute heat circumferentially and longitudinally.

In one example, the user adjusts the single flame of their torch lighter until the central deep blue cone (around 1500° C.) is approximately 0.4 inches long, and touches the tip of the central blue cone to an exterior surface 328 of thermal distribution casing 132. If present, the user may touch the flame to a point or region identified by a visual indicium 308.

The user may continue applying heat to aerosolizing thermal reactor 108 until at 808, sensory casing temperature indicator 2961 generates an alert. The duration of step 804 may depend on the size and construction of apparatus 100, the set point temperature of sensory casing temperature indicator 2961, and characteristics of the external heating source.

In some examples, step 804 has a duration of about 20 to 40 seconds until sensory casing temperature indicator 2961 generates its alert. In some examples, the sensory casing temperature indicator 2961 may have a set point temperature of between 200° C. and 400° C. Exemplary embodiments of apparatus 100 intended for use with cannabis may have an sensory casing temperature indicator 2961 with a set point temperature of greater than 255° C., such as for example 255 to 355° C., such as for example 260° C. In the context of method 800 as a whole, such elevated temperatures may permit apparatus 100 to aerosolize volatile components of cannabis (e.g. cannabinoids), which evaporate significantly at 220° C. to 240° C., and in some cases may further permit apparatus 100 to boil volatile components of cannabis (e.g. cannabinoids) which may have a boiling temperature above 250° C. (e.g. at flow constriction conduit 204, see FIG. 3).

At 812, the user waits for a first period of time. During this period, the user does not apply heat to aerosolizing thermal reactor 108. Heat from thermal distribution casing 132 evenly migrates into aerosolizable substance chamber 128 and the substance contained therein. Where the contained substance is a solid plant product, heating the contained substance during this waiting period may evaporate moisture out of the contained substance (i.e. dewater the contained substance). While moisture in the contained substance continues to evaporate, the temperature of the contained substance may effectively top out at approximately 100° C.

In some examples, the contained substance includes solid cannabis plant matter. During step 812, heat absorbed by the cannabis plant matter may initiate decarboxylation of the THC-A component into THC. It is THC and not THC-A that provides the desirable psychoactive effect when taken into the body (e.g. by inhalation).

In some examples, during step 812 the contained substance may be heated to above 100° C. Depending on the set point temperature of the casing temperature indicator 2961 and the thermal characteristics of apparatus 100, during step 812 the contained substance (e.g. cannabis) may be heated to a temperature of between 140-160° C. at which lighter terpenes and volatile components may evaporate vigorously. In some examples, during step 812 the contained substance may be heated to a temperature of between 220-240° C. at which heavier cannabinoids evaporate significantly. Where the contained substance is a solid plant matter, during step 812, the contained substance may not be heated to above the ignition temperature of the plant matter so that it does not burn. It is unpleasant and unhealthy to inhale fumes of burning plant matter.

The duration of step 812 may depend on the size and construction of apparatus 100, the set point temperature of sensory casing temperature indicator 2961, and characteristics of the contained aerosolizable substance. For example, the duration of step 812 may be at least 2 seconds. In some examples, step 812 has a duration of about 10 to 20 seconds.

Method 800 may proceed to step 816 if apparatus 100 includes a second sensory temperature indicator 296. At 816, the user may again expose aerosolizing thermal reactor 108 to heat from an external heat source. Heating at step 816 may continue until at 820, sensory chamber temperature indicator 2962 generates an alert that its set point temperature has been reached.

The duration of step 816 may depend on the size and construction of apparatus 100, the set point temperature of sensory chamber temperature indicator 2962, and characteristics of the contained aerosolizable substance. In some examples, step 820 has a duration less than the duration of step 804. For example, the duration of step 820 may be approximately 4 to 10 seconds.

In some examples, the sensory chamber temperature indicator 2962 may have a set point temperature of between 200° C. and 400° C. Exemplary embodiments of apparatus 100 intended for use with cannabis may have an sensory chamber temperature indicator 2962 with a set point temperature of greater than 200 C, such as for example between 215° C. and 280° C., such as for example 260° C. In the context of method 800 as a whole, such elevated temperatures may permit apparatus 100 to aerosolize volatile components of cannabis (e.g. cannabinoids), which evaporate significantly at 220° C. to 240° C., and in some cases may further permit apparatus 100 to boil volatile components of cannabis (e.g. cannabinoids) which may have a boiling temperature above 250° C. (e.g. at flow constriction conduit 204, see FIG. 3).

Where the contained substance is a solid plant matter, during step 816, the contained substance may not be heated to above the ignition temperature of the plant matter so that it does not burn. It is unpleasant and unhealthy to inhale fumes of burning plant matter.

At 824, the user inhales from mouthpiece 104 to withdraw aerosol generated by apparatus 100 into their lungs, and enjoy the taste and/or therapeutic effects of the aerosol. As described above with reference to FIG. 3, cold air is drawn into reactor air inlet(s) 120, and preheated in air preheating passage 136. In some embodiments, air preheating passage 136 may raise the temperature of the air stream to within 30° C. of the temperature of aerosolizable substance chamber 128 or to a temperature above that of aerosolizable substance chamber 128. The preheated air stream then mixes with the contained substance and generated aerosol. Mixing the hot air stream with the contained substance and generated aerosol may further stimulate aerosol production from the contained substance. The resulting aerosol then travels downstream to the user's mouth and into their lungs.

After inhaling at step 824, the user may wait for at least one of the sensory temperature indicators 296 to generate another alert indicating that the temperature indicator(s) 296 have crossed below their set point temperature(s). The user may repeat method 800, starting from step 816 if only sensory chamber temperature indicator 2962 has alerted that it has fallen below its set point temperature, or starting from step 804 if sensory casing temperature indicator 2961 has alerted that it has fallen below its set point temperature.

When method 800 is repeated, the duration(s) of step(s) 804 and/or 816 may be shorter (e.g. they may have one half or less of their original duration) because aerosolizing thermal reactor 108 may be preheated, and the contained substance may be preheated (and if it is solid plant matter, it may already be dewatered). In examples where the contained substance includes cannabis, both the water content and lighter terpenes may have already been vaporized, such that heat applied now will be absorbed by heavier cannabinoids. As a result, the user's inhalation at the second instance of step 824 may have greater psychoactive effect, when the contained substance includes cannabis plant.

Again, method 800 may be repeated from step 804 or 816 as described above. As more and more of the components (water, and volatile components) are vaporized, the durations of steps 804 and 816 become shorter, and when the duration falls below a threshold (e.g. less than 3 seconds, such as for example less than 2.5 seconds), it may provide an indication to the user that the contained substance is effectively spent (i.e. it can no longer generate any meaningful quantity of aerosol).

Referring to FIGS. 2 and 3, in some embodiments apparatus 100 may be disassembled for access to insert aerosolizable substance into aerosolizable substance chamber 128, for cleaning, repair, or compact storage. In the illustrated example, apparatus 100 may be disassembled into a first part 332 and a second part 336. First part 332 may include thermal distribution casing 132, mouthpiece 104, and all components in between if any (e.g. handgrip 232 and thermal break 256). First part 332 may also include aerosol outlet screen 184, which may or may not be removable. Second part 336 may include reactor distal end portion 216 (with sensory casing temperature indicator(s) 296, if any), and aerosolizable substance chamber outer and distal end walls 168, 172. Aerosolizable substance chamber outer and distal end walls 168, 172 (which may be integrally formed or otherwise permanently connected) may or may not be removable from second part 336. In alternative embodiments, apparatus 100 may not be user disassembleable (e.g. cannot be disassembled without causing damage to apparatus 100).

First and second parts 332, 336 may be removably connected in any manner, such as for example by threads 340 or a bayonet mount for example.

Figure 9:
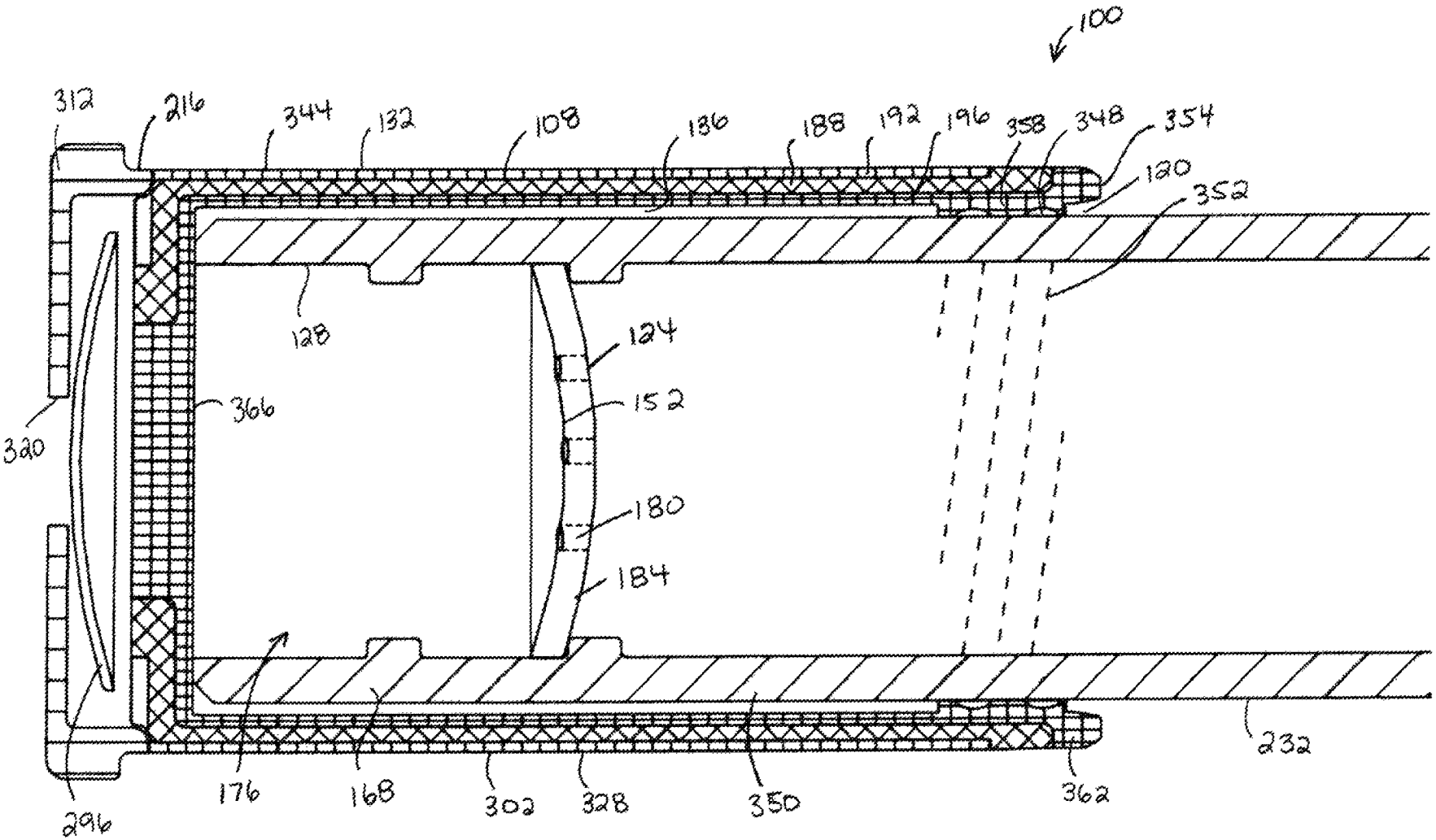
FIG. 9 is a partial cross-sectional view of an aerosol-generating apparatus, in accordance with another embodiment.

Reference is now made to FIG. 9, which shows an aerosol-generating apparatus 100 in accordance with an embodiment. Like part numbers are used to refer to like parts in the previous figures.

Apparatus 100 may have only one sensory temperature indicator 296, which may be thermally coupled to one or both of aerosolizable substance chamber 128 and thermal distribution casing 132. In the illustrated example, sensory temperature indicator 296 is thermally coupled to both. Although the illustrated embodiment of apparatus 100 may not enjoy the same level of temperature accuracy and performance as some embodiments of apparatus 100 described in connection with previous figures as having multiple sensory temperature indicator 296, the embodiment illustrated in FIG. 9 may perform reasonably well because of thermal distribution casing 132.

As shown, thermal distribution casing 132 includes a laminate material with multiple metal layers. As described above in connection with other embodiments, this design may allow thermal distribution casing 132 to more evenly circumferentially and longitudinally distribute heat applied from an external heat source at discrete point(s) or region(s) on thermal distribution casing 132. This may permit sensory temperature indicator 296 to more accurately alert to the temperature of thermal distribution casing 132 and/or aerosolizable substance chamber 128 as a whole—as compared with a single-layer (e.g. stainless steel) construction. Again, these benefits are described above in connection with other embodiments.

In some cases, a subassembly 344 including thermal distribution casing 132 (with or without a connected reactor distal end portion 216 containing an sensory temperature indicator 296) may be manufactured and sold for use with apparatus of other manufacturers (e.g. that may exist today or in the future) to upgrade such other apparatus with the multi-layer laminate construction. Subassembly 344 may be described as a thermal distribution casing 132 having a transverse casing end portion 298 covering a distal end of a casing sidewall 302. As shown, casing sidewall 302 and casing end portion 298 may together define a body receiving chamber 346 for an aerosol generating apparatus body 350. Body receiving chamber 346 may extend longitudinally from a body entry port 354 at sidewall proximal end 362 to a chamber distal end 366 proximate casing distal end portion 298.

In addition, subassembly 344 may include an audio-visual propagation aperture 320 to amplify the audible alerts generated by sensory temperature indicator 296 and allow visual inspection of sensory temperature indicator 296 (as compared to a fully enclosed temperature indicator 296). Thus, subassembly 344 may serve as a retrofit to upgrade products made by other manufacturers.

In the example shown, aerosolizing thermal reactor 108 may include a helical airflow passage 348 downstream of reactor air inlet(s) 120 and upstream of aerosolizable substance chamber 128 (e.g. upstream of air preheating passage 136). Helical airflow passage 348 may extend the flow distance from reactor air inlet(s) 120 to aerosolizable substance chamber 128, which may allow the airstream more time to receive heat from thermal distribution casing 132. As shown, helical airflow passage 348 may be defined by helical channel(s) 352 bordered by chamber outer wall 168 and helical groove(s) 356 of or on thermal distribution casing 132. Groove(s) 356 may be formed in a body spacer 358 that protrudes inwardly from thermal distribution casing 132 proximate casing distal end 388, or may be carved directly onto thermal distribution casing 132. Alternative embodiments do not include helical airflow passage 348.

Figure 10:
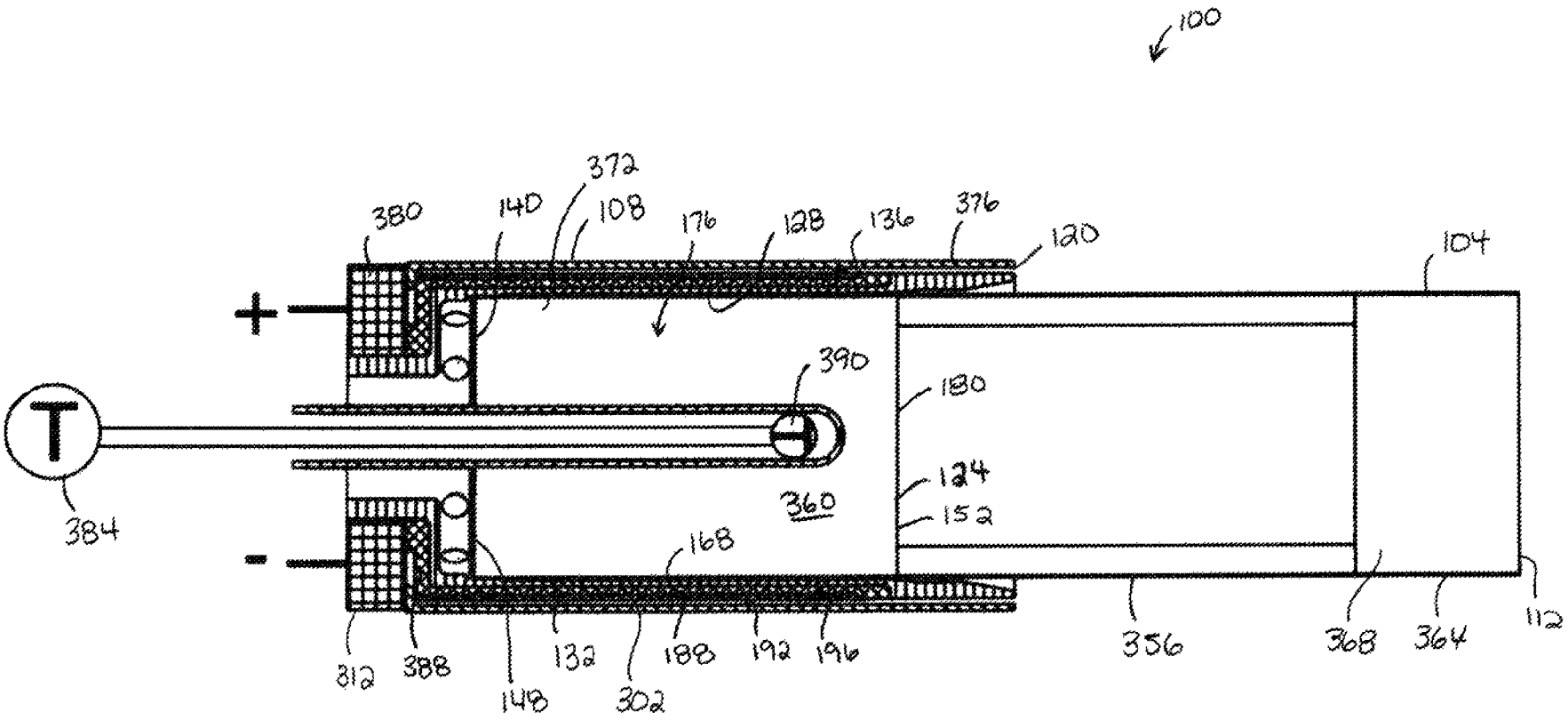
FIG. 10 is a cross-sectional view of an aerosol-generating apparatus, in accordance with another embodiment.

FIG. 10 shows another embodiment of an aerosol-generating apparatus 100. Like part numbers are used to refer to like parts in the previous figures.

The illustrated embodiment of aerosol-generating apparatus 100 is designed to receive a disposable cigarette 356 containing an aerosolizable substance 360 within an aerosolizable substance chamber 128 with a chamber outer wall 168 made of, e.g. fibrous material, paper, or thin foil. As shown, cigarette 356 may have a mouthpiece 104 at cigarette proximal end 364. A filter 368 may or may not be located downstream of aerosolizable substance chamber 128. Alternative embodiments do not include a filter 368.

As shown, thermal distribution casing 132 may define a receptacle to receive at least a distal end portion 372 of cigarette 356 containing aerosolizable substance chamber 128. In the illustrated embodiment, an air preheating passage 136 surrounds thermal distribution casing 132—which is an inverse arrangement as compared to some previously described embodiments where thermal distribution casing 132 surrounds air preheating passage 136. As shown, aerosolizing thermal reactor 108 may include a heat shield 376 that surrounds thermal distribution casing 132, and an air gap between heat shield 376 and thermal distribution casing 132 may define air preheating passage 136. Air preheating passage 136 may also provide some thermo-conductive isolation between thermal distribution casing 132 and heat shield 376, which may help maintain heat shield 376 at a temperature which is comfortable and safe for a use to hold. Alternative embodiments do not include heat shield 376.

In some embodiments, apparatus 100 may include an electric heater 380. Electric heater 380 may be powered by a battery or other electrical power source. As shown, electric heater 380 may be thermally coupled to thermal distribution casing 132. For example, electric heater 380 may have direct physical contact with thermal distribution casing 132 as shown.

Power to electric heater 380 may be controlled by a controller 384. As shown, controller 384 may be communicatively coupled to a temperature sensor 390 (e.g. a thermocouple or thermistor). Controller 384 may regulate power to electric heater 380 in response to temperature readings from temperature sensor 390. Controller 384 may regulate power to electric heater 380 based on a singular target temperature at temperature sensor 390, or based on a more complex temperature regimen prescribed by computer-readable instructions within controller 384.

Electric heater 380 may be positioned anywhere in apparatus 100. In the illustrated example, electric heater 380 is located in a distal end portion 216 of aerosolizing thermal reactor 108. For example, electric heater 380 may abut a distal end 388 of thermal distribution casing 132. As shown, thermal distribution casing 132 may include a laminate material with multiple metal layers, which depending on the selection of metal materials, may help evenly longitudinally and circumferentially distribute heat—as described above in connection with other embodiments of apparatus 100. This may permit heat from electric heater 380 to be more evenly distributed over chamber outer wall 168, and thereby more uniformly heat aerosolizable substance 360. In turn, this may allow for more efficient aerosol production (without burning aerosolizable substance 360).

Temperature sensor 390 may be positioned anywhere in apparatus 100. In the illustrated example, temperature sensor 390 is positioned and configured to penetrate aerosolizable substance 360 in chamber 128. This allows temperature sensor 390 to detect the temperature of aerosolizable substance 360. In turn, controller 384 may regulate power to electric heater 380 based on target temperature(s) for aerosolizable substance 360 selected to achieve efficient aerosolization without burning aerosolizable substance 360.

Figures 11A, 11B, 11C:
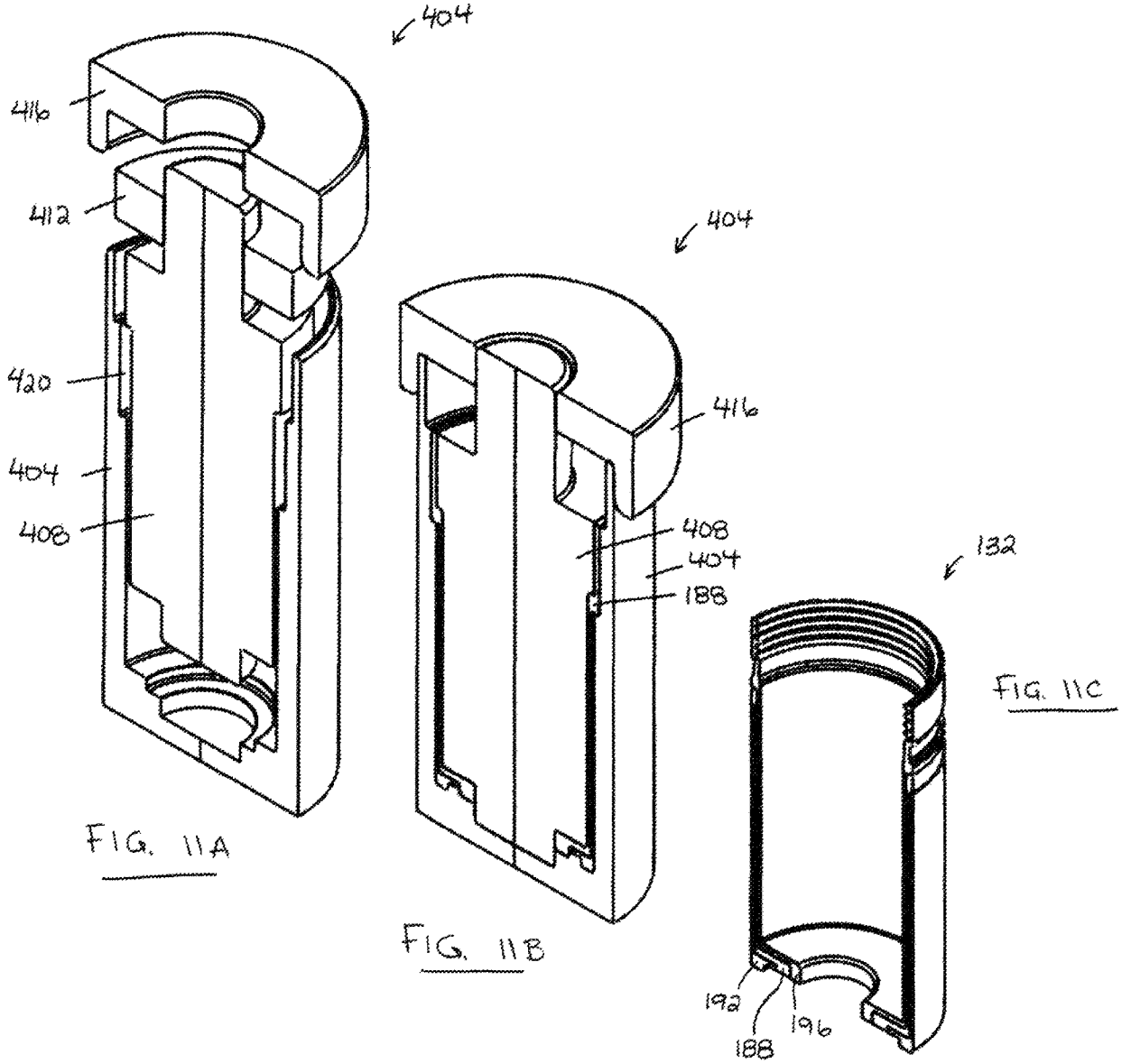
FIGS. 11A-C show steps in a method of making a thermal distribution casing, in accordance with an embodiment.

Reference is now made to FIGS. 11A-11C, which illustrate steps in a method of making a thermal distribution casing 132 in accordance with an embodiment.

FIG. 11A shows an assembly 400 including outer layer blank 404, an inner layer blank 408, a middle layer slug 412, and an alignment cap 416. For clarity, all parts are shown in cross-section. Inner layer blank 408 is placed inside outer layer blank 404 with an air gap 420 between them. As shown, air gap 420 may be annular and surround outer layer blank 404. Middle layer slug 412 may be placed over air gap 420. Alignment cap 416 may maintain alignment between inner and outer layer blanks 408 so that even spacing between outer and inner layer blanks 404, 408 is maintained through the process.

Blank assembly 400 may be placed into a vacuum furnace. The vacuum furnace evacuates all of the air inside, and melts the middle layer slug 412. Accordingly, the furnace temperature is set to above the melting point of the middle layer slug 412, and below the melting points of the outer and inner layer blanks 404, 408. As shown in FIG. 11B, the melted middle layer slug fills the air gap between outer and inner layer blanks 404, 408.

Finally, turning to FIG. 11C, blank assembly 400 is allowed to cool, alignment cap 416 is removed, and outer and inner blanks 404, 408 are machined to form a thermal distribution casing 132 having a laminate material with metal outer and inner layers 192, 196 permanently laminated to metal middle layer 188. Metal layers 188, 192, and 196 may be made of any suitable metals, such as metal materials described herein in connection with various embodiments of thermal distribution casing 132. In one example, metal middle layer is a high thermal conductivity material (e.g. copper), metal outer layer 192 is an induction heating compatible ferromagnetic material (e.g. martensitic steel), and metal inner layer is medical grade metal (e.g. 316 austenitic steel).

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items

Item 1: An aerosol-generating apparatus comprising:

a mouthpiece having an inhalation outlet; and an aerosolizing thermal reactor having an air inlet upstream of an aerosol outlet, wherein the aerosol outlet is upstream of the inhalation outlet, the aerosolizing thermal reactor comprising an aerosolizable substance chamber having a chamber outer wall surrounding a chamber inner volume, the chamber inner volume located upstream of the aerosol outlet, a thermal distribution casing surrounding the aerosolizable substance chamber, the thermal distribution casing comprising a laminate material with an at least three-layer construction including a metal middle layer between a metal outer layer and a metal inner layer, the metal middle layer composed of a middle metal material having a middle thermal conductivity, the metal outer layer composed of an outer metal material having an outer thermal conductivity, the metal inner layer composed of an inner metal material having an inner thermal conductivity, and the middle thermal conductivity being at least double each of the outer thermal conductivity and the inner thermal conductivity, and an air preheating passage located downstream of the air inlet and upstream of the aerosolizable substance chamber, the air preheating passage surrounding the aerosolizable substance chamber, and the air preheating passage being defined by an air gap between the chamber outer wall and the metal inner layer.

Item 2: The aerosol-generating apparatus of any preceding item, further comprising:

an sensory casing temperature indicator thermally coupled to the thermal distribution casing, and an sensory chamber temperature indicator thermally coupled to the aerosolizable substance chamber.

Item 3: The aerosol-generating apparatus of any preceding item, wherein:

the sensory casing temperature indicator has a set point temperature at which the sensory casing temperature indicator generates an audible alert, the sensory chamber temperature indicator has a set point temperature at which the sensory chamber temperature indicator generates an audible alert, and the set point temperature of the sensory casing temperature indicator is different from the sensory chamber temperature indicator.

Item 4: The aerosol-generating apparatus of any preceding item, wherein:

the aerosolizing thermal reactor including a reactor distal end portion that contains the sensory casing temperature indicator, and contains an audio-visual propagation aperture that provides line-of-sight to the sensory casing temperature indicator from outside the aerosol-generating apparatus.

Item 5: The aerosol-generating apparatus of any preceding item, wherein:

the distal end portion comprises a sound propagation conduit extending longitudinally from proximate the sensory chamber temperature indicator to proximate the sensory casing temperature indicator.

Item 6: The aerosol-generating apparatus of any preceding item, wherein:

the aerosolizing thermal reactor has a reactor distal end portion that includes a thermal break contributing thermal conduction isolation between the thermal distribution casing and the aerosolizable substance chamber.

Item 7: The aerosol-generating apparatus of any preceding item, wherein:

the thermal break comprises a compressed spring biasing the aerosolizable substance chamber away from the reactor distal end portion.

Item 8: The aerosol-generating apparatus of any preceding item, wherein:

at least the middle metal material defines a flow constriction conduit proximate the aerosol outlet.

Item 9: The aerosol-generating apparatus of any preceding item, further comprising:

a handgrip extending longitudinally between the mouthpiece and the aerosolizing thermal reactor, the handgrip having a hollow-core construction including a handgrip inner conduit inside a handgrip outer shell, and an annular air gap extending between the handgrip outer shell and the handgrip inner conduit.

Item 10: The aerosol-generating apparatus of any preceding item, further comprising:

a manually user-adjustable flow control valve located downstream of the aerosol outlet and upstream of the inhalation outlet.

Item 11: The aerosol-generating apparatus of any preceding item, further comprising:

a handgrip extending longitudinally between the mouthpiece and the aerosolizing thermal reactor, the handgrip having a handgrip conduit inlet downstream of the aerosol outlet and a handgrip conduit outlet upstream of the inhalation outlet; and a manually user-adjustable flow control valve located at the handgrip conduit inlet.

Item 12: The aerosol-generating apparatus of any preceding item, wherein:

the handgrip comprises a handgrip inner conduit inside a handgrip outer shell, the handgrip inner conduit includes the handgrip conduit inlet and the handgrip conduit outlet, and a flow constriction imparted by the flow control valve is manually user-adjustable by rotating the handgrip inner conduit relative to the handgrip outer shell.

Item 13: The aerosol-generating apparatus of any preceding item, wherein:

an annular air gap extends between the handgrip outer shell and the handgrip inner conduit, the flow control valve is manually user-adjustable between a fully open position and a fully closed position, and the annular air gap is fluidly sealed from the aerosol outlet both when the flow control valve is in the fully open position and when the flow control valve is in the fully closed position.

Item 14: The aerosol-generating apparatus of any preceding item, wherein:

the handgrip comprises a handgrip inner conduit inside a handgrip outer shell, and a flow constriction imparted by the flow control valve is manually user-adjustable by rotating the mouthpiece relative to the handgrip outer shell.

Item 15: The aerosol-generating apparatus of any preceding item, further comprising:

a thermal break positioned between the aerosolizing thermal reactor and the handgrip outer shell.

Item 16: The aerosol-generating apparatus of any preceding item, further comprising:

a thermal break and a handgrip, the thermal break connecting the aerosolizing thermal reactor to the handgrip, and the handgrip connecting the thermal break to the mouthpiece.

Item 17: The aerosol-generating apparatus of any preceding item, wherein:

at least one of the outer metal material, middle metal material, and inner metal material is ferromagnetic.

Item 18: An aerosol-generating apparatus comprising:

a mouthpiece having an inhalation outlet; and an aerosolizing thermal reactor having an air inlet upstream of an aerosol outlet, wherein the aerosol outlet is upstream of the inhalation outlet, the aerosolizing thermal reactor comprising an aerosolizable substance chamber having a chamber outer wall surrounding a chamber inner volume, the chamber inner volume located upstream of the aerosol outlet, a thermal distribution casing surrounding the aerosolizable substance chamber, and an air preheating passage located downstream of the air inlet and upstream of the aerosolizable substance chamber, the air preheating passage surrounding the aerosolizable substance chamber, and the air preheating passage being defined by an air gap between the chamber outer wall and the thermal distribution casing;

an sensory casing temperature indicator thermally coupled to the thermal distribution casing; and an sensory chamber temperature indicator thermally coupled to the aerosolizable substance chamber.

Item 19: The aerosol-generating apparatus of any preceding item, wherein:

the sensory casing temperature indicator has a set point temperature at which the sensory casing temperature indicator generates an audible alert, the sensory chamber temperature indicator has a set point temperature at which the sensory chamber temperature indicator generates an audible alert, and the set point temperature of the sensory casing temperature indicator is different from the sensory chamber temperature indicator.

Item 20: A thermal distribution casing for an aerosol-generating apparatus body, the thermal distribution casing comprising:

a sidewall extending longitudinally from a sidewall proximal end to a sidewall distal end, the sidewall comprising a laminate material with an at least three-layer construction including a metal middle layer between a metal outer layer and a metal inner layer, the metal middle layer composed of a middle metal material having a middle thermal conductivity, the metal outer layer composed of an outer metal material having an outer thermal conductivity, the metal inner layer composed of an inner metal material having an inner thermal conductivity, and the middle thermal conductivity being at least double each of the outer thermal conductivity and the inner thermal conductivity;

a transverse distal end portion covering the sidewall distal end, the distal end portion comprising an sensory temperature indicator, the sidewall and distal end portion together defining a body receiving chamber for an aerosol generating apparatus body, the body receiving chamber extending longitudinally from a body entry port at the sidewall proximal end to a chamber distal end proximate the distal end portion.

Item 21: The thermal distribution casing of any preceding item, further comprising:

a body spacer protruding transversely inwardly from the sidewall and located proximate the sidewall distal end.

Item 22: The thermal distribution casing of any preceding item, wherein:

the body spacer and sidewall collectively define at least a portion of an air inlet.

Item 23: The thermal distribution casing of any preceding item, wherein:

the sidewall defines at least a portion of a longitudinally extending air preheating passage bordered by the metal inner layer.

Item 24: An aerosol-generating apparatus comprising:

a thermal distribution casing defining an aerosolizable substance receiving chamber, the aerosolizable substance receiving chamber extending longitudinally from a chamber entry port at a proximal end of the thermal distribution casing, the thermal distribution casing comprising a laminate material with an at least three-layer construction including a metal middle layer between a metal outer layer and a metal inner layer, the metal middle layer composed of a middle metal material having a middle thermal conductivity, the metal outer layer composed of an outer metal material having an outer thermal conductivity, the metal inner layer composed of an inner metal material having an inner thermal conductivity, and the middle thermal conductivity being at least double each of the outer thermal conductivity and the inner thermal conductivity;

a heat shield surrounding the thermal distribution casing;

an air preheating passage located upstream of the aerosolizable substance chamber, the air preheating passage surrounding the thermal distribution casing, and the air preheating passage being defined by an air gap between the heat shield and the metal outer layer; and an electric heater thermally coupled to the thermal distribution casing.

Item 25: The aerosol-generating apparatus of any preceding item, further comprising:

a temperature probe positionable inside the aerosolizable substance receiving chamber; and a controller communicatively coupled to the temperature probe and configured to regulate power to the electric heater based at least in part on temperature readings from the temperature probe.

Item 26: A method of generating an aerosol from an aerosolizable substance, the method comprising:

(i) exposing an aerosolizing thermal reactor to an external heat source until a first sensory temperature indicator generates an alert, the aerosolizing thermal reactor containing an aerosolizable substance;

(ii) immediately after (i), ceasing said exposing the aerosolizing thermal reactor to the external heat source for a first period of time of at least 2 seconds;

(iii) immediately after (ii), exposing the aerosolizing thermal reactor to the external heat source until a second sensory temperature indicator generates an alert; and (iv) after (iii), drawing air through the aerosolizing thermal reactor to withdraw aerosol generated from the aerosolizable substance.

Item 27: The method of any preceding item, wherein:

step (i) raises a temperature of the aerosolizing substance to at least 100° C. and moisture evaporates out of the aerosolizable substance.

Item 28: The method of any preceding item, wherein:

step (iii) heats a chamber containing the aerosolizable substance to a chamber temperature $T_2$; and step (iv) comprises drawing air through a preheating passage, in which air is heated to a pre-heat temperature greater than ($T_2$-30° C.), into the chamber containing the aerosolizable substance.

Item 29: The method of any preceding item, wherein:

step (i) and step (iii) each comprise exposing a thermal distribution casing to the external heat source, the thermal distribution casing comprising a laminate material with an at least three-layer construction including a metal middle layer between a metal outer layer and a metal inner layer, the metal middle layer composed of a middle metal material having a middle thermal conductivity, the metal outer layer composed of an outer metal material having an outer thermal conductivity, the metal inner layer composed of an inner metal material having an inner thermal conductivity, and the middle thermal conductivity being at least double each of the outer thermal conductivity and the inner thermal conductivity.

The invention claimed is:

1. A thermal distribution casing for an aerosol-generating apparatus body, the thermal distribution casing comprising:

a sidewall extending longitudinally from a sidewall proximal end to a sidewall distal end, the sidewall comprising a multi-layer construction, the multi-layer construction having at least a first metal layer and a second metal layer, the first metal layer composed of a first metal material having a first thermal conductivity, the second metal layer composed of a second metal material having a second thermal conductivity, and the first thermal conductivity being at least double of the second thermal conductivity;

a distal end portion transversely covering the sidewall distal end, the distal end portion comprising a sensory temperature indicator, the sidewall and distal end portion together defining a body receiving chamber for an aerosol generating apparatus body, the body receiving chamber extending longitudinally from a body entry port at the sidewall proximal end to a chamber distal end proximate the distal end portion;

wherein the sensory temperature indicator has a set point temperature at which the sensory temperature indicator generates an audible alert.

2. The thermal distribution casing of claim 1, wherein:

the first metal layer has a different color from the second metal layer, and at least a portion of the first metal layer is visible on an exterior surface of the thermal distribution casing.

3. The thermal distribution casing of claim 1, wherein:

the distal end portion contains an audio-visual propagation aperture that provides line-of-sight to the sensory temperature indicator from outside the thermal distribution casing.

4. The thermal distribution casing of claim 1, wherein:

the sidewall defines at least a portion of a longitudinally extending air preheating passage bordered by at least one of the first and second metal layers.

5. The thermal distribution casing of claim 1, wherein:

at least a portion of the sidewall is cylindrical.

6. The thermal distribution casing of claim 1, wherein:

the first metal material comprises copper.

7. An aerosol-generating apparatus comprising the thermal distribution casing of claim 1.

8. A thermal distribution casing for an aerosol-generating apparatus body, the thermal distribution casing comprising:

a sidewall extending longitudinally from a sidewall proximal end to a sidewall distal end, the sidewall comprising a multi-layer construction, the multi-layer construction having at least a first metal layer and a second metal layer, the first metal layer composed of a first metal material having a first thermal conductivity, the second metal layer composed of a second metal material having a second thermal conductivity, the first thermal conductivity being greater than the second thermal conductivity, and the first thermal conductivity being greater than 200 W/m·K;

a distal end portion transversely covering the sidewall distal end, the distal end portion comprising a sensory temperature indicator, the sidewall and distal end portion together defining a body receiving chamber for an aerosol generating apparatus body, the body receiving chamber extending longitudinally from a body entry port at the sidewall proximal end to a chamber distal end proximate the distal end portion;

wherein the sensory temperature indicator has a set point temperature at which the sensory temperature indicator generates an audible alert.

9. The thermal distribution casing of claim 8, wherein:

the first metal layer has a different color from the second metal layer, and at least a portion of the first metal layer is visible on an exterior surface of the thermal distribution casing.

10. The thermal distribution casing of claim 8, wherein:

the distal end portion contains an audio-visual propagation aperture that provides line-of-sight to the sensory temperature indicator from outside the thermal distribution casing.

11. The thermal distribution casing of claim 8, wherein:

the sidewall defines at least a portion of a longitudinally extending air preheating passage bordered by at least one of the first and second metal layers.

12. The thermal distribution casing of claim 8, wherein:

at least one of the first metal material and the second metal material is a ferromagnetic metal material.

13. An aerosol-generating apparatus comprising the thermal distribution casing of claim 8.

* * * * *